US009199352B2

(12) United States Patent
Seki et al.

(10) Patent No.: US 9,199,352 B2
(45) Date of Patent: Dec. 1, 2015

(54) POLISHING APPARATUS, POLISHING METHOD AND PRESSING MEMBER FOR PRESSING A POLISHING TOOL

(75) Inventors: Masaya Seki, Tokyo (JP); Kenya Ito, Tokyo (JP); Masayuki Nakanishi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 606 days.

(21) Appl. No.: 12/986,481

(22) Filed: Jan. 7, 2011

(65) Prior Publication Data

US 2011/0237164 A1 Sep. 29, 2011

(30) Foreign Application Priority Data

Jan. 15, 2010 (JP) ..... 2010-006674
Dec. 24, 2010 (JP) ..... 2010-287242

(51) Int. Cl.

| | |
|---|---|
| ***B24B 9/00*** | (2006.01) |
| ***B24B 9/06*** | (2006.01) |
| ***B24B 21/00*** | (2006.01) |
| ***B24B 37/27*** | (2012.01) |

(52) U.S. Cl.

CPC ..... *B24B 9/065* (2013.01); *B24B 21/004* (2013.01); *B24B 37/27* (2013.01)

(58) Field of Classification Search

CPC ..... B24B 9/065; B24B 21/002; B24B 21/02; B24B 21/06; H01L 21/02021; H01L 21/304
USPC ..... 451/44, 285–290
See application file for complete search history.

(56) References Cited

U.S. PATENT DOCUMENTS

| | | | | |
|---|---|---|---|---|
| 4,344,260 | A * | 8/1982 | Ogiwara | 451/44 |
| 5,609,514 | A * | 3/1997 | Yasunaga et al. | 451/65 |
| 6,933,234 | B2 * | 8/2005 | Nakamura et al. | 438/690 |
| 7,108,582 | B2 | 9/2006 | Sato et al. | |
| 7,744,445 | B2 * | 6/2010 | Kubota et al. | 451/41 |
| 2001/0011002 | A1 * | 8/2001 | Steere, III | 451/168 |
| 2002/0137439 | A1 * | 9/2002 | Hakomori et al. | 451/44 |
| 2002/0164930 | A1 * | 11/2002 | Hakomori | 451/44 |
| 2002/0182985 | A1 * | 12/2002 | Shiino et al. | 451/44 |
| 2004/0072504 | A1 * | 4/2004 | Tada | 451/41 |
| 2005/0090189 | A1 * | 4/2005 | Brown et al. | 451/41 |
| 2008/0293336 | A1 | 11/2008 | Zhang et al. | |
| 2009/0124174 | A1 * | 5/2009 | Fukushima et al. | 451/44 |
| 2009/0142992 | A1 | 6/2009 | Takahashi et al. | |
| 2009/0227189 | A1 | 9/2009 | Maeda et al. | |
| 2009/0275269 | A1 * | 11/2009 | Sakairi | 451/44 |

FOREIGN PATENT DOCUMENTS

| | | |
|---|---|---|
| JP | 2002-208572 | 7/2002 |
| JP | 2003-266292 | 9/2003 |
| JP | 2005-305586 | 11/2005 |

(Continued)

*Primary Examiner* — Maurina Rachuba
(74) *Attorney, Agent, or Firm* — Wenderoth, Lind & Ponack, L.L.P.

(57) ABSTRACT

A polishing apparatus polishes a top edge portion and/or a bottom edge portion of a substrate accurately and uniformly. The polishing apparatus includes a rotary holding mechanism configured to hold the substrate horizontally and to rotate the substrate and at least one polishing head disposed near the peripheral portion of the substrate. The polishing head has at least one protrusion extending along a circumferential direction of the substrate, and the polishing head is configured to press a polishing surface of a polishing tape by the protrusion against the peripheral portion of the substrate from above or below.

31 Claims, 35 Drawing Sheets

(56) References Cited

FOREIGN PATENT DOCUMENTS

| | | |
|---|---|---|
| JP | 2007-524231 | 8/2007 |
| JP | 2008-91951 | 4/2008 |
| JP | 2009-154285 | 7/2009 |
| JP | 2009-208214 | 9/2009 |

* cited by examiner

POLISHING APPARATUS, POLISHING METHOD AND PRESSING MEMBER FOR PRESSING A POLISHING TOOL

BACKGROUND OF THE INVENTION

1. Field of the Invention

The present invention relates to a polishing apparatus and a polishing method for polishing a substrate, such as a semiconductor wafer, and more particularly to a polishing apparatus and a polishing method for polishing a peripheral portion of a substrate using a strip-shaped polishing tool, such as a polishing tape. The present invention also relates to a pressing member for pressing the strip-shaped polishing tool against the peripheral portion of the substrate.

2. Description of the Related Art

From a viewpoint of improving yield in fabrication of semiconductor devices, management of surface conditions of a peripheral portion of a substrate has been attracting attention in recent years. In the fabrication process of the semiconductor devices, many materials are deposited on a silicon wafer to form a multilayer structure. Therefore, unwanted films and roughened surface are formed on a peripheral portion of the substrate which is not used for products. It has been a recent trend to transport the substrate by holding only its peripheral portion using arms. Under such circumstances, the unwanted films remaining on the peripheral portion would be peeled off during various processes and could adhere to devices, causing lowered yield. Thus, a polishing apparatus for polishing the peripheral portion of the substrate has been used in order to remove the unwanted films and roughened surface therefrom.

An apparatus using a polishing tape for polishing the peripheral portion of the substrate is known as such a polishing apparatus. This type of polishing apparatus polishes the peripheral portion of the substrate by bringing a polishing surface of the polishing tape in contact with the peripheral portion of the substrate. In this specification, the peripheral portion is defined as a region including a bevel portion which is the outermost portion of the substrate and a top edge portion and bottom edge portion located radially inwardly of the bevel portion.

FIG. 1A and FIG. 1B are enlarged cross-sectional views each showing a peripheral portion of a substrate. More specifically, FIG. 1A shows a cross-sectional view of a so-called straight-type substrate, and FIG. 1B shows a cross-sectional view of a so-called round-type substrate. In the substrate W shown in FIG. 1A, the bevel portion is a portion B that is constituted by an upper slope (an upper bevel portion) P, a lower slope (a lower bevel portion) Q, and a side portion (an apex) R, all of which form an outermost circumferential surface of the substrate W. In the substrate W shown in FIG. 1B, the bevel portion is a portion B having a curved cross section and forming an outermost circumferential surface of the substrate W. The top edge portion is a flat portion E1 located radially inwardly of the bevel portion B and located radially outwardly of a region D where devices are formed. The bottom edge portion is a flat portion E2 located opposite the top edge portion and located radially inwardly of the bevel portion B. These top edge portion E1 and bottom edge portion E2 may be collectively referred to as near-edge portions.

In the conventional polishing apparatus, the polishing tape is pressed by a polishing head against the peripheral portion of the substrate to thereby polish the peripheral portion (for example, see Japanese laid-open patent publication No. 2009-154285). The polishing head has a flat pressing surface, which presses the polishing tape against the peripheral portion of the substrate, while the polishing head is inclined, to thereby polish the peripheral portion. However, it is difficult to accurately polish the top edge portion and the bottom edge portion by the flat pressing surface. For example, in the substrate shown in FIG. 1A, it is difficult to polish only the top edge portion E1 accurately along a boundary between the device region D and the top edge portion E1. In particular, when the polishing head is inclined such that the polishing tape makes an acute angle with a surface of the substrate, the devices may be damaged by the polishing tape.

Japanese laid-open patent publication No. 2009-208214 discloses a polishing apparatus having linear pressing surface. In this polishing apparatus, as shown in FIG. 2A, a pressing member 100 having the linear pressing surface is moved in a radially outward direction of the substrate W at a constant speed, while pressing a polishing tape 101 against the top edge portion of the substrate W. The polishing apparatus thus structured can polish the top edge portion without damaging the device region. However, as shown in FIG. 2B, since a distance between the linearly-extending pressing surface and the outermost circumference of the substrate W is not constant, a contact time between the polishing tape and the substrate becomes shorter in an inner edge of the top edge portion than in other regions. As a result, as shown in FIG. 2C, the inner edge of the top edge portion is scraped obliquely.

SUMMARY OF THE INVENTION

The present invention has been made in view of the above drawbacks. It is therefore an object of the present invention to provide a polishing apparatus capable of polishing a top edge portion and/or a bottom edge portion of a substrate accurately and uniformly. Further, another object of the present invention is to provide a polishing method using such a polishing apparatus and to provide a pressing member for pressing a polishing tool used in the polishing apparatus.

In order to achieve the above object, one aspect of the present invention provides a polishing apparatus for polishing a peripheral portion of a substrate. The apparatus includes: a rotary holding mechanism configured to hold the substrate horizontally and to rotate the substrate; and at least one polishing head disposed near the peripheral portion of the substrate. The polishing head has at least one protrusion extending along a circumferential direction of the substrate, and wherein the polishing head is configured to press a polishing surface of a strip-shaped polishing tool by the protrusion against the peripheral portion of the substrate from above or below.

In a preferred aspect of the present invention, the protrusion has a circular arc shape that has substantially the same curvature as the substrate.

In a preferred aspect of the present invention, the polishing apparatus further includes at least one tilting mechanism configured to tilt the polishing head with respect to a surface of the substrate. The at least one protrusion comprises a first protrusion and a second protrusion that are symmetrically arranged. The first protrusion is located above the peripheral portion of the substrate when the polishing head is tilted upward, and the second protrusion is located below the peripheral portion of the substrate when the polishing head is tilted downward.

In a preferred aspect of the present invention, the first protrusion presses the polishing tool against a top edge portion of the substrate, and the second protrusion presses the polishing tool against a bottom edge portion of the substrate.

In a preferred aspect of the present invention, the at least one polishing head comprises plural polishing heads arranged around the substrate, and the at least one tilting mechanism comprises plural tilting mechanisms configured to tilt the plural polishing heads independently.

In a preferred aspect of the present invention, the polishing head further has a pressing pad configured to press the polishing tool against the peripheral portion of the substrate, and the pressing pad is disposed between the first protrusion and the second protrusion.

In a preferred aspect of the present invention, a height of the pressing pad is lower than a height of the first protrusion and the second protrusion.

In a preferred aspect of the present invention, the polishing head further has a pressing pad configured to press the polishing tool against the peripheral portion of the substrate, and the pressing pad is adjacent to the protrusion.

In a preferred aspect of the present invention, a length of the protrusion is longer than a width of the polishing tool.

In a preferred aspect of the present invention, the polishing head includes two guide rollers that support the polishing surface of the polishing tool and further includes an actuator coupled to the two guide rollers and the protrusion. The protrusion is interposed between the two guide rollers, and the actuator is configured to move the two guide rollers and the protrusion in unison toward the peripheral portion of the substrate.

In a preferred aspect of the present invention, the strip-shaped polishing tool is a polishing tape or a polishing cloth.

Another aspect of the present invention provides a polishing apparatus for polishing a peripheral portion of a substrate. The apparatus includes: a rotary holding mechanism configured to hold the substrate horizontally and to rotate the substrate; a polishing head disposed near the peripheral portion of the substrate; and a tilting mechanism configured to tilt the polishing head with respect to a surface of the substrate. The polishing head has a first protrusion and a second protrusion extending along a circumferential direction of the substrate and further has a pressing pad disposed between the first protrusion and the second protrusion. The polishing head is configured to press a polishing surface of a strip-shaped polishing tool by the first protrusion against the peripheral portion of the substrate from above, to press the polishing surface of the polishing tool by the second protrusion against the peripheral portion of the substrate from below, and to press the polishing surface of the polishing tool by the pressing pad against the peripheral portion of the substrate.

Still another aspect of the present invention provides a polishing method using the above-described polishing apparatus. The method includes: rotating a substrate by the rotary holding mechanism; pressing the polishing tool by the first protrusion against a peripheral portion of the substrate from above to thereby polish a top edge portion of the substrate; and pressing the polishing tool by the second protrusion against the peripheral portion of the substrate from below to thereby polish a bottom edge portion of the substrate.

Still another aspect of the present invention provides a polishing method using the above-described polishing apparatus. The method includes: rotating a substrate by the rotary holding mechanism; pressing the polishing tool by the first protrusion against a peripheral portion of the substrate from above to thereby polish a top edge portion of the substrate; pressing the polishing tool by the second protrusion against the peripheral portion of the substrate from below to thereby polish a bottom edge portion of the substrate; and pressing the polishing tool by the pressing pad against the peripheral portion of the substrate to thereby polish a bevel portion of the substrate.

Still another aspect of the present invention provides a polishing method using the above-described polishing apparatus. The method includes: rotating a substrate by the rotary holding mechanism; pressing a strip-shaped polishing tool by a first polishing head against a peripheral portion of the substrate from above to thereby polish a top edge portion of the substrate; pressing the strip-shaped polishing tool by the first polishing head against the peripheral portion of the substrate from below to thereby polish a bottom edge portion of the substrate; and during polishing of the bottom edge portion by the first polishing head, pressing a strip-shaped polishing tool by a second polishing head against the peripheral portion of the substrate from above to thereby polish the top edge portion.

Still another aspect of the present invention provides a polishing method using the above-described polishing apparatus. The method includes: rotating a substrate by the rotary holding mechanism; pressing a strip-shaped polishing tool by a first polishing head against a peripheral portion of the substrate from above to thereby polish a top edge portion of the substrate; and pressing a strip-shaped polishing tool by a second polishing head against the peripheral portion of the substrate from below to thereby polish a bottom edge portion of the substrate.

Still another aspect of the present invention provides a pressing member for pressing a strip-shaped polishing tool against a peripheral portion of a substrate. The pressing member includes at least one protrusion extending along a circumferential direction of the substrate.

According to the present invention, the protrusion presses the polishing tool (e.g., polishing tape) against the peripheral portion of the substrate. Therefore, the polishing tool can accurately polish the peripheral portion without contacting regions other than the peripheral portion. Further, because the protrusion is curved along the circumferential direction of the substrate, the contact time between the substrate and the polishing tool is uniform over polishing region in its entirety. Therefore, it is possible to uniformly polish the entire polishing region including the inner edge of the peripheral portion of the substrate.

DETAILED DESCRIPTION OF THE INVENTION

Embodiments of the present invention will be described below with reference to the drawings.

Figure 3:
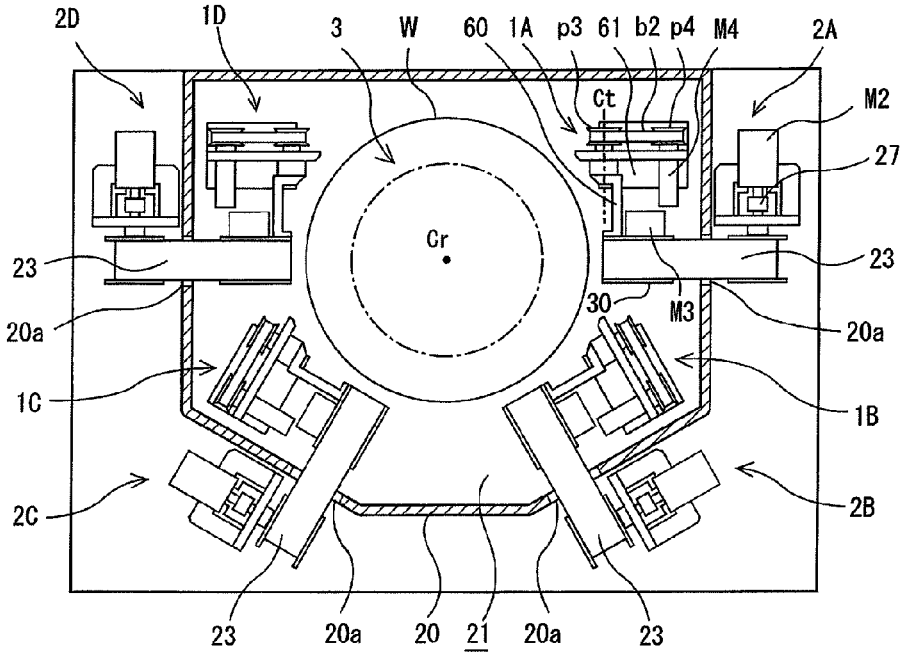
FIG. 3 is a plan view showing a polishing apparatus according to an embodiment of the present invention.
Figure 4:
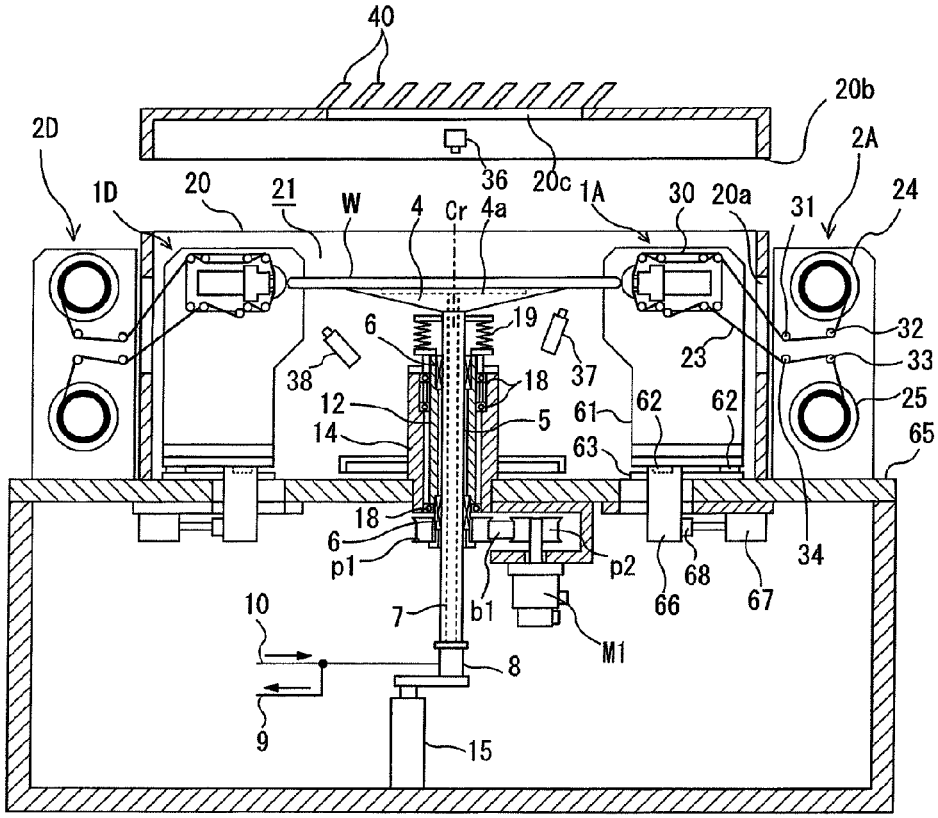
FIG. 4 is a vertical cross-sectional view of the polishing apparatus shown in FIG. 3.

FIG. 3 is a plan view showing a polishing apparatus according to an embodiment of the present invention. FIG. 4 is a vertical cross-sectional view of the polishing apparatus shown in FIG. 3. As shown in FIG. 3 and FIG. 4, the polishing apparatus includes a rotary holding mechanism (a substrate holder) 3 configured to hold a substrate W (i.e., a workpiece to be polished) horizontally and to rotate the substrate W. The rotary holding mechanism 3 is located in the center of the polishing apparatus. FIG. 3 shows a state in which the rotary holding mechanism 3 holds the substrate W. This rotary holding mechanism 3 has a dish-shaped holding stage 4 configured to hold a rear surface of the substrate W by a vacuum suction, a hollow shaft 5 coupled to a central portion of the holding stage 4, and a motor M1 for rotating the hollow shaft 5. The substrate W is placed onto the holding stage 4 by hands of a transporting mechanism (not shown) such that a center of the substrate W is aligned with a central axis of the hollow shaft 5.

The hollow shaft 5 is supported by ball spline bearings (i.e., linear motion bearings) 6 which allow the hollow shaft 5 to move vertically. The holding stage 4 has an upper surface having grooves 4*a*. These grooves 4*a* communicate with a communication passage 7 extending through the hollow shaft 5. The communication passage 7 is coupled to a vacuum line 9 via a rotary joint 8 provided on a lower end of the hollow shaft 5. The communication passage 7 is also coupled to a nitrogen-gas supply line 10 for use in releasing the substrate W from the holding stage 4 after processing. By selectively coupling the vacuum line 9 and the nitrogen-gas supply line 10 to the communication passage 7, the substrate W can be held on the upper surface of the holding stage 4 by the vacuum suction and can be released from the upper surface of the holding stage 4.

A pulley p1 is coupled to the hollow shaft 5, and a pulley p2 is mounted on a rotational shaft of the motor M1. The hollow shaft 5 is rotated by the motor M1 through the pulley p1, the pulley p2, and a belt b1 riding on these pulleys p1 and p2. With these structures, the substrate W, held on the upper surface of the holding stage 4, is rotated by the motor M1.

The ball spline bearing 6 is a bearing that allows the hollow shaft 5 to move freely in its longitudinal direction. The ball spline bearings 6 are secured to a cylindrical casing 12. Therefore, the hollow shaft 5 can move linearly up and down relative to the casing 12, and the hollow shaft 5 and the casing 12 rotate in unison. The hollow shaft 5 is coupled to an air cylinder (elevating mechanism) 15, so that the hollow shaft 5 and the holding stage 4 are elevated and lowered by the air cylinder 15.

A cylindrical casing 14 is provided so as to surround the casing 12 in a coaxial arrangement. Radial bearings 18 are provided between the casing 12 and the casing 14, so that the casing 12 is rotatably supported by the radial bearings 18. With these structures, the rotary holding mechanism 3 can rotate the substrate W about its central axis Cr and can elevate and lower the substrate W along the central axis Cr.

As shown in FIG. 3, four polishing head assemblies (polishing units) 1A, 1B, 1C, and 1D are arranged around the substrate W held by the rotary holding mechanism 3. Polishing-tape supply mechanisms 2A, 2B, 2C, and 2D are provided radially outwardly of the polishing head assemblies 1A, 1B, 1C, and 1D, respectively. The polishing head assemblies 1A, 1B, 1C, and 1D are isolated from the polishing-tape supply mechanisms 2A, 2B, 2C, and 2D by a partition 20. An interior space of the partition 20 provides a polishing room 21. The four polishing head assemblies 1A, 1B, 1C, and 1D and the holding stage 4 are located in the polishing room 21. On the other hand, the polishing-tape supply mechanisms 2A, 2B, 2C, and 2D are located outside the partition 20 (i.e., outside the polishing room 21). The polishing head assemblies 1A, 1B, 1C, and 1D have the same structure, and the polishing-tape supply mechanisms 2A, 2B, 2C, and 2D also have the same structure. Hereinafter, the polishing head assembly 1A and the polishing-tape supply mechanism 2A will be described.

The polishing-tape supply mechanism 2A has a supply reel 24 for supplying a polishing tape 23 to the polishing head assembly 1A, and a recovery reel 25 for recovering the polishing tape 23 that has been used in polishing of the substrate W. The supply reel 24 is arranged above the recovery reel 25. Motors M2 are coupled to the supply reel 24 and the recovery reel 25, respectively, via couplings 27 (FIG. 3 shows only the coupling 27 and the motor M2 coupled to the supply reel 24). Each of the motors M2 is configured to exert a constant torque in a predetermined rotational direction so as to apply a predetermined tension to the polishing tape 23.

The polishing tape 23 is a long strip-shaped polishing tool, and one of surfaces thereof provides a polishing surface. The polishing tape 23 includes a base tape made from PET sheet or the like and a polishing layer formed on the base tape. The polishing layer comprises a binder (e.g., resin) covering one surface of the base tape and abrasive grains bound by the binder. A surface of the polishing layer provides the polishing surface. Instead of the polishing tape, a strip-shaped polishing cloth may be used as the polishing tool.

The polishing tape 23 is wound on the supply reel 24, which is mounted on the polishing-tape supply mechanism 2A. Side surfaces of the wound polishing tape 23 are supported by reel plates so that the wound polishing tape 23 does not collapse. One end of the polishing tape 23 is attached to the recovery reel 25. The recovery reel 25 takes up the polishing tape 23 that has been supplied to the polishing head assembly 1A to thereby recover the polishing tape 23. The polishing head assembly 1A has a polishing head 30 for pressing the polishing tape 23, supplied from the polishing-tape supply mechanism 2A, against a peripheral portion of the substrate W. The polishing tape 23 is supplied to the polishing head 30 such that the polishing surface of the polishing tape 23 faces the substrate W.

The polishing-tape supply mechanism 2A has plural guide rollers 31, 32, 33, and 34. The polishing tape 23, to be supplied to and recovered from the polishing head assembly 1A, is guided by these guide rollers 31, 32, 33, and 34. The polishing tape 23 is supplied to the polishing head 30 from the supply reel 24 through an opening 20*a* formed in the partition 20, and the polishing tape 23 that has been used in polishing of the substrate is recovered by the recovery reel 25 through the opening 20*a*.

As shown in FIG. 4, an upper supply nozzle 36 is provided above the substrate W. This upper supply nozzle 36 is configured to supply a polishing liquid onto a center of an upper surface of the substrate W held by the rotary holding mechanism 3. Further, a lower supply nozzle 37 is provided for supplying a polishing liquid onto a boundary between the rear surface of the substrate W and the holding stage 4 (i.e., onto a peripheral portion of the holding stage 4). Typically, pure water is used as the polishing liquid. In a case of using silica as the abrasive grains of the polishing tape 23, ammonia may be used as the polishing liquid. The polishing apparatus further includes a cleaning nozzle 38 for cleaning the polishing head 30 after the polishing process. The substrate W is elevated by the rotary holding mechanism 3 after the polishing process, and then the cleaning nozzle 38 ejects cleaning water toward the polishing head 30, whereby the polishing head 30 is cleaned after the polishing process.

In order to isolate mechanical devices, such as the ball spline bearings 6 and the radial bearings 18, from the polishing room 21 when the hollow shaft 5 is elevated and lowered relative to the casing 12, the hollow shaft 5 and an upper end of the casing 12 are coupled to each other by a bellows 19 that is extensible and contractible in a vertical direction, as shown in FIG. 4. FIG. 4 shows a state in which the hollow shaft 5 is in a lowered position and the holding stage 4 is in a polishing position. After the polishing process, the air cylinder 15 elevates the substrate W, together with the holding stage 4 and the hollow shaft 5, to a transport position, where the substrate W is released from the holding stage 4.

The partition 20 has an entrance 20*b* through which the substrate W is transported into and removed from the polishing room 21. The entrance 20*b* is a horizontally extending cutout. Therefore, the substrate W, held by the transporting mechanism, can travel horizontally across the polishing room 21 through the entrance 20*b*. An upper surface of the partition 20 has an aperture 20*c* and louvers 40, and a lower surface of the partition 20 has a gas-discharge opening (not shown in the drawing). During the polishing process, the entrance 20*b* is closed by a non-illustrated shutter. Therefore, as a fan mechanism (not shown in the drawing) is driven to evacuate an air through the gas-discharge opening, downward flow of clean air is formed in the polishing room 21. Because the polishing process is performed under such conditions, the polishing liquid is prevented from scattering upwardly. Therefore, the polishing process can be performed while an upper space of the polishing room 21 is kept clean.

As shown in FIG. 3, the polishing head 30 is secured to one end of an arm 60, which is rotatable about an axis Ct extending parallel to a tangential direction of the substrate W. The other end of the arm 60 is coupled to a motor M4 via pulleys p3 and p4 and a belt b2. As the motor M4 rotates in a clockwise direction and a counterclockwise direction through a certain angle, the arm 60 rotates about the axis Ct through a certain angle. In this embodiment, the motor M4, the arm 60, the pulleys p3 and p4, and the belt b2 constitute a tilting mechanism for tilting the polishing head 30 with respect to the surface of the substrate W.

The tilting mechanism is mounted on a movable base 61. This movable base 61 is movably coupled to a base plate 65 via guides 62 and rails 63. The rails 63 extend linearly in a radial direction of the substrate W held on the rotary holding mechanism 3, so that the movable base 61 can move linearly in the radial direction of the substrate W. A connection plate 66, extending through the base plate 65, is secured to the movable base 61. A linear actuator 67 is coupled to the connection plate 66 via a joint 68. This linear actuator 67 is secured to the base plate 65 directly or indirectly.

The linear actuator 67 may comprise an air cylinder or a combination of a positioning motor and a ball screw. The linear actuator 67, the rails 63, and the guides 62 constitute a moving mechanism for linearly moving the polishing head 30 in the radial direction of the substrate W. Specifically, the moving mechanism is operable to move the polishing head 30 closer to and away from the substrate W along the rails 63. On the other hand, the polishing-tape supply mechanism 2A is fixed to the base plate 65.

Figure 5:
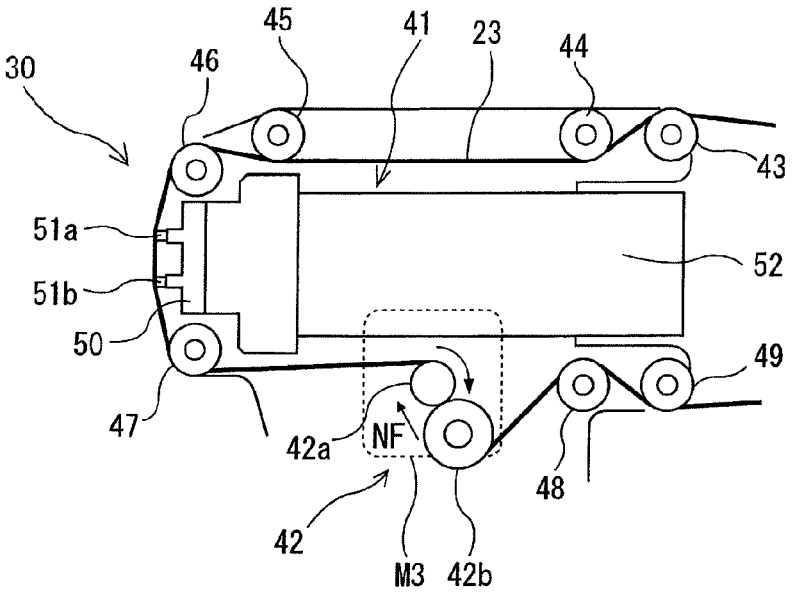
FIG. 5 is an enlarged view of a polishing head.

FIG. 5 is an enlarged view of the polishing head 30. As shown in FIG. 5, the polishing head 30 has a pressing mechanism 41 configured to press the polishing surface of the polishing tape 23 against the substrate W at predetermined force. The polishing head 30 further has a tape-sending mechanism 42 configured to send the polishing tape 23 from the supply reel 24 to the recovery reel 25. The polishing head 30 has plural guide rollers 43, 44, 45, 46, 47, 48, and 49, which guide the polishing tape 23 such that the polishing tape 23 travels in a direction perpendicular to the tangential direction of the substrate W.

The tape-sending mechanism 42 of the polishing head 30 includes a tape-sending roller 42*a*, a tape-holding roller 42*b*, and a motor M3 configured to rotate the tape-sending roller 42*a*. The motor M3 is mounted on a side surface of the polishing head 30. The tape-sending roller 42*a* is mounted to a rotational shaft of the motor M3. The tape-holding roller 42*b* is adjacent to the tape-sending roller 42*a*. The tape-holding roller 42*b* is supported by a non-illustrated mechanism, which biases the tape-holding roller 42*b* in a direction indicated by arrow NF in FIG. 5 (i.e., in a direction toward the tape-sending roller 42*a*) so as to press the tape-holding roller 42*b* against the tape-sending roller 42*a*.

As the motor M3 rotates in a direction indicated by arrow in FIG. 5, the tape-sending roller 42*a* is rotated to send the polishing tape 23 from the supply reel 24 to the recovery reel 25 via the polishing head 30. The tape-holding roller 42*b* is configured to be rotatable freely about its own axis and is rotated as the polishing tape 23 is sent.

The pressing mechanism 41 includes a pressing member 50 located at the rear side of the polishing tape 23 and an air cylinder (an actuator) 52 configured to move the pressing member 50 toward the peripheral portion of the substrate W. The air cylinder 52 is a so-called single rod cylinder. The force of the pressing member 50 that presses the polishing tape 23 against the substrate W is regulated by controlling air pressure supplied to the air cylinder 52. The four polishing head assemblies 1A, 1B, 1C, and 1D arranged around the substrate W have the tilting mechanisms, the pressing mechanisms 41, the tape-sending mechanisms 42, and the polishing-head moving mechanisms, which are capable of operating independently.

Figure 6:
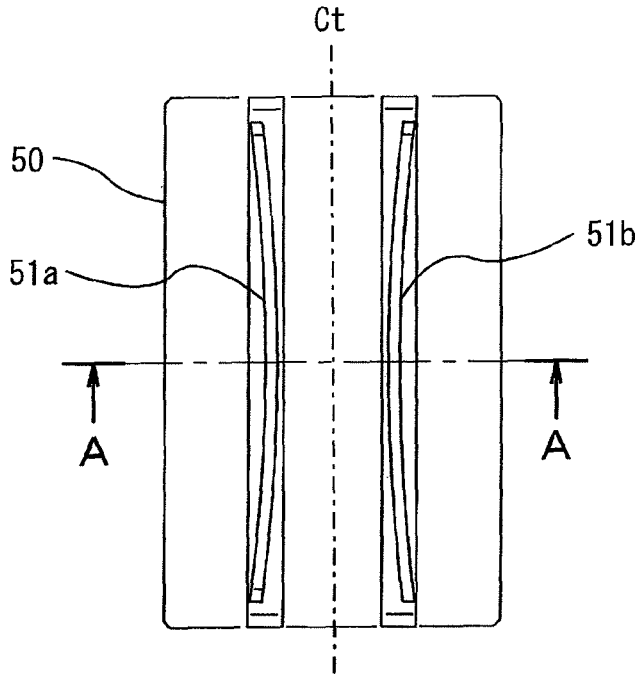
FIG. 6 is a front view of a pressing member shown in FIG. 5.
Figure 7:
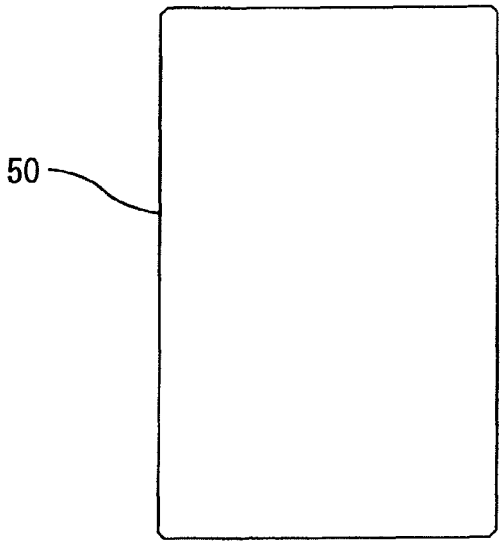
FIG. 7 is a rear view of the pressing member shown in FIG. 6.
Figure 8:
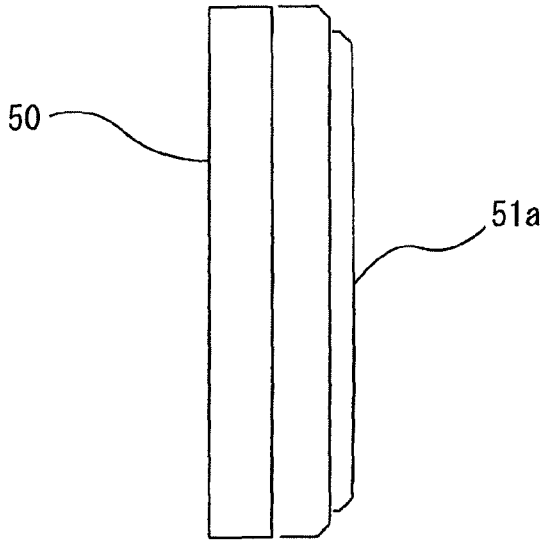
FIG. 8 is a left-side view of the pressing member shown in FIG. 6.
Figure 9:
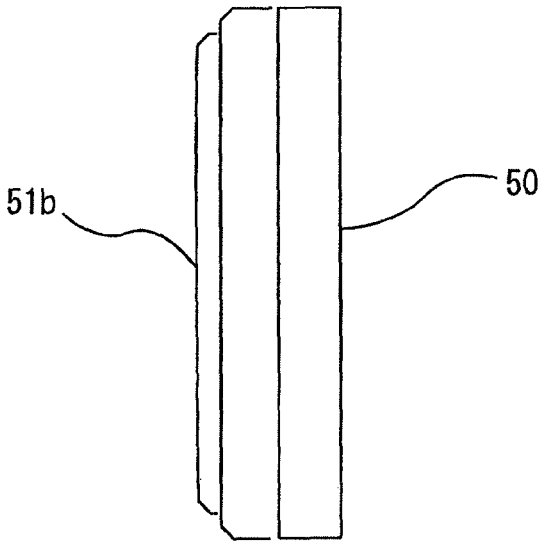
FIG. 9 is a right-side view of the pressing member shown in FIG. 6.
Figure 10:
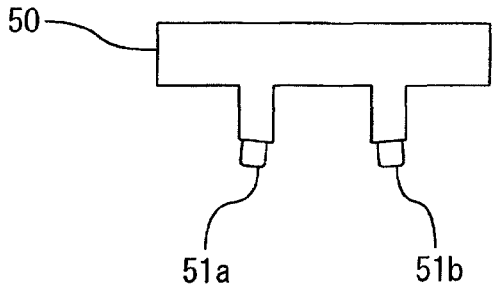
FIG. 10 is a top view of the pressing member shown in FIG. 6.
Figure 11:
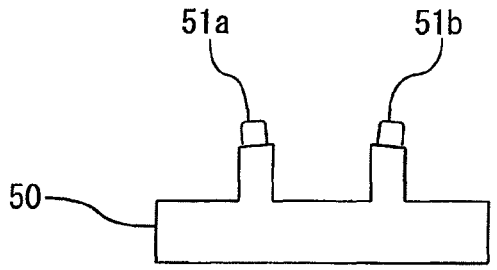
FIG. 11 is a bottom view of the pressing member shown in FIG. 6.

FIG. 6 through FIG. 11 are front, rear, left-side, right-side, top, and bottom views of the pressing member shown in FIG. 5. As shown in FIG. 6 through FIG. 11, the pressing member 50 has two protrusions 51*a* and 51*b* formed on a front surface thereof. These protrusions 51*a* and 51*b* are in a shape of rail and are arranged in parallel. The protrusions 51*a* and 51*b* are curved along the circumferential direction of the substrate W. More specifically, the protrusions 51*a* and 51*b* have a circular arc shape whose curvature is substantially the same as a curvature of the substrate W. The two protrusions 51*a* and 51*b* are symmetrical about the rotational axis Ct. As shown in FIG. 6, the protrusions 51*a* and 51*b* are curved inwardly toward the rotational axis Ct as viewed from a front of the pressing member 50. The polishing head 30 is disposed such that a center line (i.e., the rotational axis Ct) extending between tip ends of the protrusions 51*a* and 51*b* coincides with a center of a thickness of the substrate W. The protrusions 51*a* and 51*b* are arranged such that the protrusions 51*a* and 51*b* are closer to the substrate W than the guide rollers 46 and 47 that are disposed at the front of the polishing head 30, so that the polishing tape 23 is supported from the rear side thereof by the protrusions 51*a* and 51*b*. The protrusions 51*a* and 51*b* are made from resin, such as PEEK (polyetheretherketone).

Figure 12:
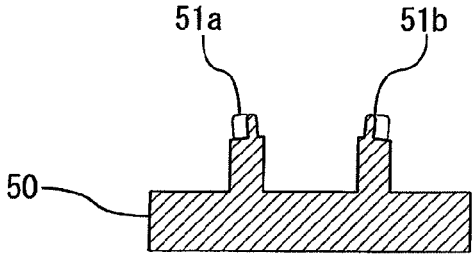
FIG. 12 is a cross-sectional view taken along line A-A in FIG. 6.
Figure 13:
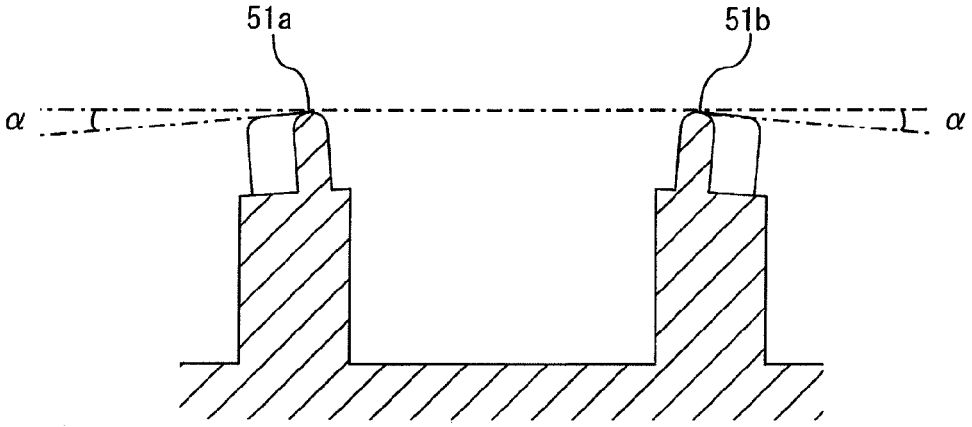
FIG. 13 is an enlarged view of protrusions shown in FIG. 12.

FIG. 12 is a cross-sectional view taken along line A-A in FIG. 6. FIG. 13 is an enlarged view of the protrusions shown in FIG. 12. The protrusions 51*a* and 51*b* have pressing surfaces, respectively, for pressing the polishing tape 23 against the substrate W. Each pressing surface has a rounded cross section. The entire pressing surface of the protrusion 51*a* is slightly inclined with respect to the polishing tape 23 extending between the protrusion 51*a* and the protrusion 51*b*. Similarly, the entire pressing surface of the protrusion 51*b* is slightly inclined with respect to the polishing tape 23 extending between the protrusion 51*a* and the protrusion 51*b*. In FIG. 13, an angle of the pressing surface with respect to the polishing tape 23 is represented by $\alpha$.

Figure 14:
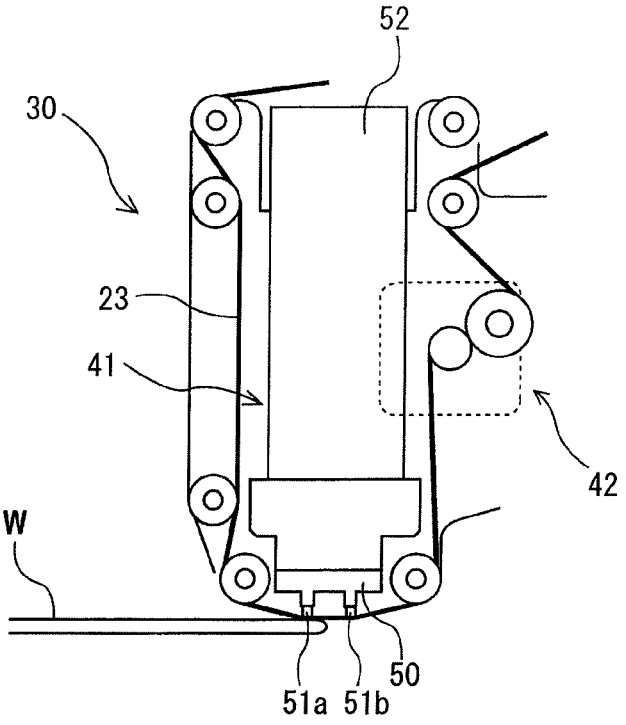
FIG. 14 is a view showing the polishing head inclined upward by a tilting mechanism.
Figure 15:
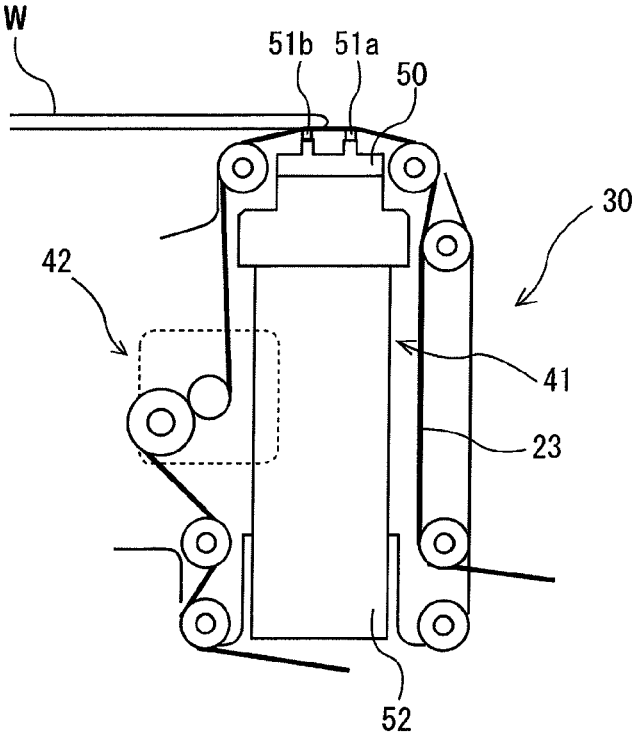
FIG. 15 is a view showing the polishing head inclined downward by the tilting mechanism.

FIG. 14 is a view showing the polishing head inclined upward by the tilting mechanism, and FIG. 15 is a view showing the polishing head inclined downward by the tilting mechanism. As shown in FIG. 14 and FIG. 15, when the polishing head 30 is tilted upward, the upper protrusion (first protrusion) 51*a* is located above the peripheral portion of the substrate W to face the top edge portion. When the polishing head 30 is tilted downward, the lower protrusion (second protrusion) 51*b* is located below the peripheral portion of the substrate W to face the bottom edge portion. When polishing the top edge portion, the polishing head 30 is inclined upward and in this state the protrusion 51*a* presses the polishing tape 23 against the peripheral portion of the substrate W from above (i.e., against the top edge portion). On the other hand, when polishing the bottom edge portion, the polishing head 30 is inclined downward and in this state the protrusion 51*b* presses the polishing tape 23 against the peripheral portion of the substrate W from below (i.e., against the bottom edge portion). Pressing forces of the protrusions 51*a* and 51*b* can be regulated by the air cylinder 52.

The tilt angles of the polishing head 30 when polishing the top edge portion and the bottom edge portion are such that the entire pressing surface of the protrusion is parallel to the surface (i.e., the upper surface or the lower surface) of the substrate W. By tilting the polishing head 30 at such angle, the polishing tape 23 extending between the protrusion 51*a* and the protrusion 51*b* is separated from the surface of the substrate W, because the pressing surface of each protrusion is inclined as shown in FIG. 13. Therefore, the polishing tape 23 is substantially in line contact with the substrate W. In one embodiment, the angle $\alpha$ of the pressing surface shown in FIG. 13 is 5 degrees.

Figure 16A:
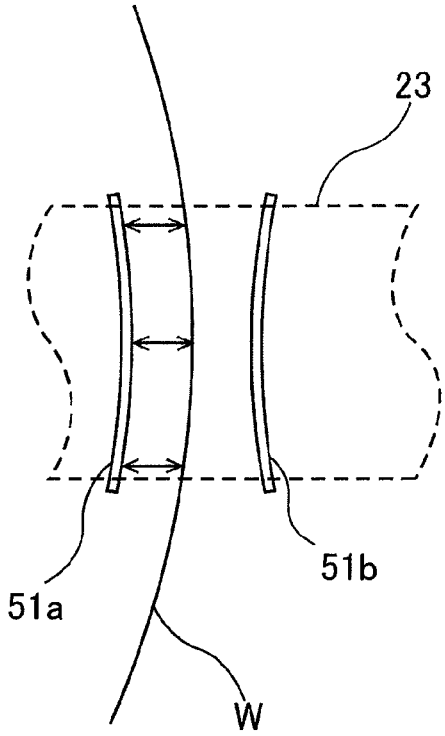
FIG. 16A is a plan view showing a manner in which the upper protrusion brings a polishing tape in contact with a top edge portion of the substrate.
Figure 16B:
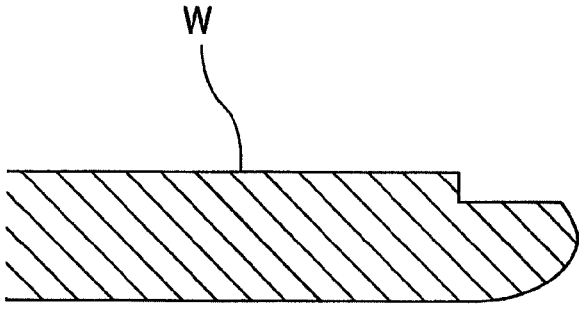
FIG. 16B is a schematic view showing a cross section of the peripheral portion of the substrate that has been polished.

FIG. 16A is a plan view showing a manner in which the upper protrusion brings the polishing tape in contact with the top edge portion of the substrate, and FIG. 16B is a schematic view showing a cross section of the peripheral portion of the substrate that has been polished. When polishing the top edge portion, the polishing head 30 is tilted upward until the pressing surface of the protrusion 51*a* is parallel to the upper surface (i.e., the top edge portion) of the substrate W. In this state, the upper protrusion 51*a* presses the polishing tape 23 against the top edge portion. While pressing the polishing tape 23 against the substrate W, the polishing head 30 is moved in a radially outward direction of the substrate W at a constant speed by the above-described moving mechanism constituted by the linear actuator 67 and other elements.

Figure 1A:
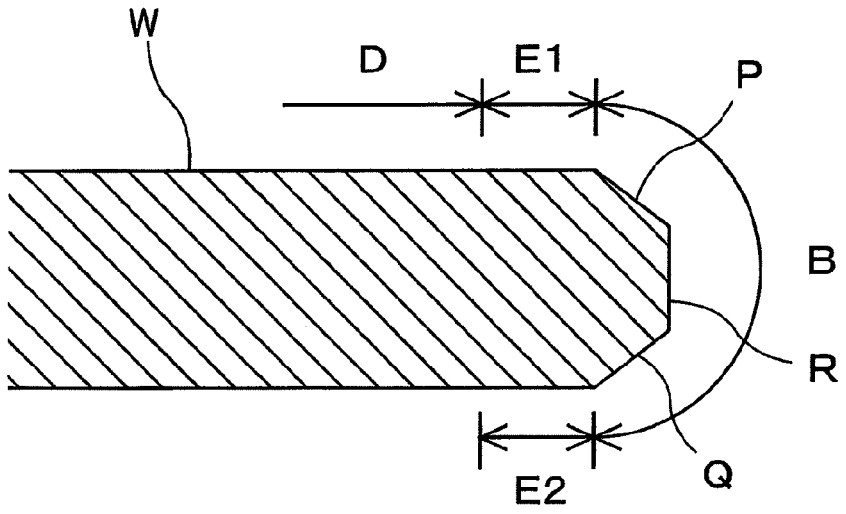
FIG. 1A and FIG. 1B are enlarged cross-sectional views each showing a periphery of a substrate.
Figure 1B:
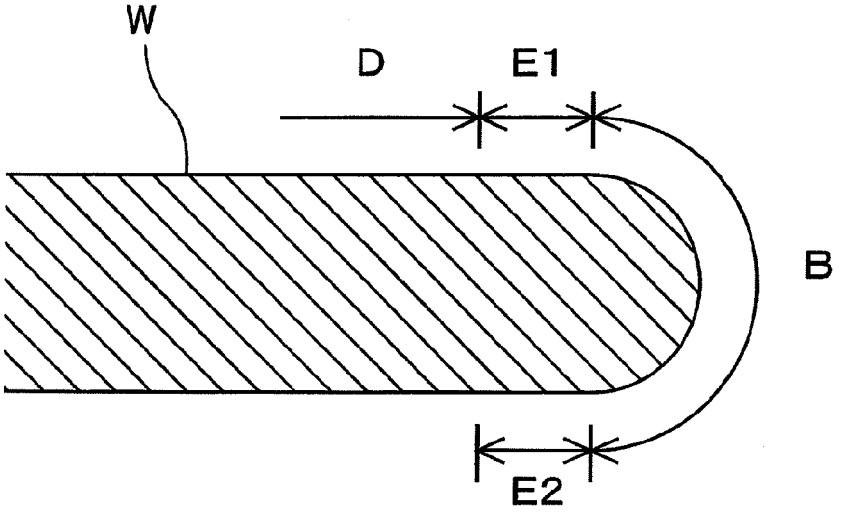

When the protrusion 51*a* is pressing the polishing tape 23 against the top edge portion, a polishing width (i.e., a distance between the protrusion 51*a* and the outermost circumference of the substrate W) is constant throughout the entire length of the protrusion 51*a*, as shown in FIG. 16A. This is because the protrusion 51*a* is curved along the peripheral portion of the substrate W as viewed from above. Use of such protrusion 51*a* enables the polishing tape 23 to polish only the top edge portion accurately without damaging the device region (see reference symbol D in FIG. 1A and FIG. 1B).

The substrate W is polished by sliding contact with the polishing tape 23. Therefore, an amount of film removed by the polishing tape 23 is determined by a cumulative contact time between the substrate W and the polishing tape 23. According to this embodiment of the polishing apparatus, the contact time of the polishing tape 23 with the substrate W is uniform over the top edge portion in its entirety, because the protrusion 51*a* is curved along the peripheral portion of the substrate W. Therefore, as shown in FIG. 16B, the top edge portion in its entirety can be polished uniformly. Further, use of the curved protrusion 51*a* can provide a longer contact length between the polishing tape 23 and the substrate W, thus increasing a polishing rate.

The upper protrusion 51*a* and the lower protrusion 51*b* are symmetrical with respect to the rotational axis Ct. Therefore, as shown in FIG. 15, when the polishing head 30 is tilted downward until the lower protrusion 51*b* faces the bottom edge portion, the protrusion 51*b* extends along the bottom edge portion of the substrate W. Therefore, the bottom edge portion can be polished accurately and uniformly by the protrusion 51*b*, as well as the top edge portion.

Figure 2A:
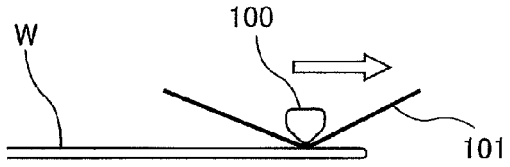
FIG. 2A PRIOR ART
FIG. 2A is a side view showing a part of a conventional polishing apparatus.
Figure 2B:
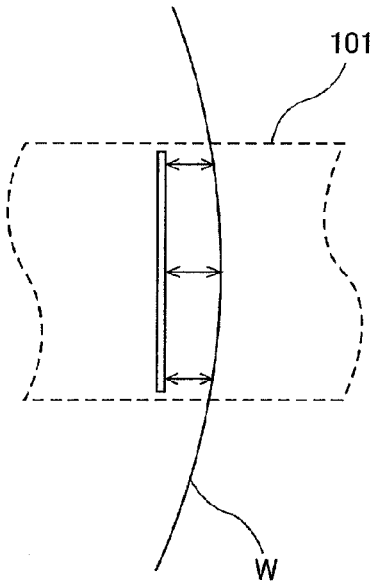
FIG. 2B PRIOR ART
FIG. 2B is a plan view showing a positional relationship between a pressing surface and a substrate.

As shown in FIG. 16A, it is preferable that length of the protrusions 51*a* and 51*b* be longer than a width of the polishing tape 23. Specifically, it is preferable that the length of the protrusions 51*a* and 51*b* be longer than the width of the polishing tape 23 by about 2 mm. In this case, the protrusions 51*a* and 51*b* are arranged such that the protrusions 51*a* and 51*b* extend beyond both sides of the polishing tape 23 by about 1 mm. As shown in FIG. 2B, if the length of the pressing surface of the pressing member 100 is shorter than the width of the polishing tape 101, both side portions of the polishing tape 101 would flutter when the polishing tape 101 is tensioned and may damage the substrate W. According to the embodiment described above, the protrusions 51*a* and 51*b* that are longer than the width of the polishing tape 23 are used. As a result, the polishing tape 23 is supported over its full width by the protrusions 51*a* and 51*b*, and therefore the polishing tape 23 can be sent stably.

Polishing of the top edge portion is performed as follows. First, the substrate W is rotated about its axis by the rotary holding mechanism 3. Subsequently, the polishing liquid (e.g., pure water) is supplied onto the substrate W from the upper supply nozzle 36 and the lower supply nozzle 37. As shown in FIG. 14, the polishing head 30 is inclined upward by the tilting mechanism until the protrusion 51*a* faces the top edge portion of the substrate W. Then, the polishing tape 23 is pressed against the top edge portion from above by the upper protrusion 51*a*, while the tape-sending mechanism 42 sends the polishing tape 23 in its longitudinal direction. In this state, the polishing head 30 is moved in the radially outward direction of the substrate W at a constant speed by the linear actuator 67, thereby polishing the top edge portion.

Polishing of the bottom edge portion is performed in the same manner as polishing of the top edge portion. Specifically, the substrate W is rotated about its axis by the rotary holding mechanism 3. Subsequently, the polishing liquid (e.g., pure water) is supplied onto the substrate W from the upper supply nozzle 36 and the lower supply nozzle 37. As shown in FIG. 15, the polishing head 30 is inclined downward by the tilting mechanism until the protrusion 51*b* faces the bottom edge portion of the substrate W. Then, the polishing tape 23 is pressed against the bottom edge portion from below by the lower protrusion 51*b*, while the tape-sending mechanism 42 sends the polishing tape 23 in its longitudinal direction. In this state, the polishing head 30 is moved in the radially outward direction of the substrate W at a constant speed, thereby polishing the bottom edge portion.

Since the polishing tape 23 is supported by the protrusions 51*a* and 51*b*, a space is formed between the polishing tape 23 and the pressing member 50. This space serves as a hole that allows the polishing liquid, that has been supplied to the substrate W, to pass therethrough. Specifically, when the top edge portion and the bottom edge portion are being polished, the polishing liquid is supplied to the rotating substrate W as described above. The polishing liquid on the substrate W is spun off from the substrate W by centrifugal force, and most of the polishing liquid passes through the space between the polishing tape 23 and the pressing member 50 without impinging upon the pressing member 50. In this manner, because the polishing liquid, scattered from the substrate W, hardly impinges upon the pressing member 50, the polishing liquid does not bounce back onto the substrate W. Therefore, contamination of the substrate W due to particles, such as polishing debris, contained in the polishing liquid can be prevented.

Figure 17:
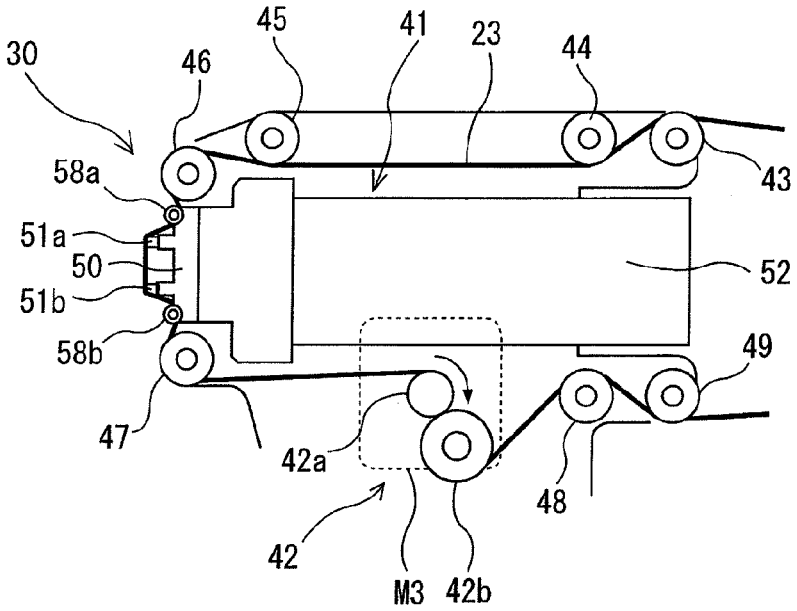
FIG. 17 is a view showing another example of the polishing head.

FIG. 17 is a view showing another example of the polishing head. Structures and operations of the polishing head that are not described below are identical to those of the polishing head shown in FIG. 5 and FIG. 6. As shown in FIG. 17, two guide rollers 58*a* and 58*b* are disposed such that the two protrusions 51*a* and 51*b* are interposed therebetween. More specifically, the guide roller 58*a* is arranged between the upper protrusion 51*a* and the guide roller 46, and the guide roller 58*b* is arranged between the lower protrusion 51*b* and the guide roller 47. The guide rollers 58*a* and 58*b* are supported by the pressing member 50, so that the guide rollers 58*a* and 58*b* and the protrusions 51*a* and 51*b* are moved in unison toward and away from the peripheral portion of the substrate W by the air cylinder 52.

A traveling direction of the polishing tape 23 is guided by the guide roller 46, the guide roller 58*a*, the protrusions 51*a* and 51*b*, the guide roller 58*b*, and the guide roller 47 in this order. The guide rollers 46 and 47, which are disposed at the front of the polishing head 30, support the rear surface of the polishing tape 23. The guide rollers 58*a* and 58*b*, which are coupled to the air cylinder 52, support the polishing surface of the polishing tape 23. The guide rollers 58*a* and 58*b* are arranged farther away from the substrate W than the protrusions 51*a* and 51*b* so that the guide rollers 58*a* and 58*b* do not contact the substrate W. A portion of the polishing tape 23 extending between the guide roller 46 and the protrusion 51*a* and a portion of the polishing tape 23 extending between the guide roller 47 and the protrusion 51*b* are guided by the guide rollers 58*a* and 58*b* in a direction away from the substrate W. The guide rollers 58*a* and 58*b* thus arranged can separate the portions of the polishing tape 23 located at both sides (i.e., upstream side and downstream side) of the protrusions 51*a* and 51*b* from the substrate W. Therefore, the polishing tape 23 can be reliably prevented from contacting regions other than the peripheral portion.

Further, the polishing head 30 shown in FIG. 17 is advantageous in that, because the guide rollers 58*a* and 58*b* are coupled to the air cylinder 52, the pressing force applied to the substrate W is not lowered with the increase in the tension of the polishing tape 23. In the conventional polishing apparatus shown in FIG. 2A, when the tension of the polishing tape 101 is increased, a force acts on the pressing member 100 in a direction away from the substrate W. As a result, the pressing force applied to the substrate is reduced and the polishing rate is lowered. In contrast, in the polishing head 30 shown in FIG. 17, the guide rollers 58*a* and 58*b*, which support the polishing surface of the polishing tape 23, are coupled to the air cylinder 52. According to these arrangements, when the tension of the polishing tape 23 is increased, a force is exerted on the pressing member 50 in a direction toward the substrate W. Therefore, the increase in the tension of the polishing tape 23 does not cause a decrease in the pressing force applied to the substrate W. As a result, the polishing head 30 can polish the peripheral portion of the substrate W at high polishing rate.

As shown in FIG. 3, the polishing apparatus according to the embodiment has the multiple polishing head assemblies and multiple polishing-tape supply mechanisms. Therefore, multiple polishing heads 30 can polish the peripheral portion of the substrate W simultaneously. For example, in order to increase the polishing rate, it is possible to polish only the top edge portion or only the bottom edge portion by the plural polishing heads 30 using the same type of polishing tapes. It is also possible to polish the top edge portion by the polishing head assembly 1A and to polish the bottom edge portion by the polishing head assembly 1B simultaneously.

Further, it is possible to polish the top edge portion and the bottom edge portion successively by the plural polishing heads 30. For example, the polishing head assembly 1A presses a polishing tape against the top edge portion of the substrate W to polish the top edge portion, subsequently the polishing head assembly 1A presses the polishing tape against the bottom edge portion of the substrate W to polish the bottom edge portion, and the polishing head assembly 1B presses a polishing tape against the top edge portion of the substrate W to polish the top edge portion during polishing of the bottom edge portion by the polishing head assembly 1A. In this case, different types of polishing tapes can be used in the polishing head assembly 1A and the polishing head assembly 1B. For example, the polishing head assembly 1A may use a polishing tape for rough polishing, and the polishing head assembly 1B may use a polishing tape for finish polishing. According to the above-described embodiment of the polishing apparatus, each polishing head 30 has the two protrusions 51*a* and 51*b*, which allow greater flexibility of the polishing process of the peripheral portion of the substrate. Therefore, desired polishing recipes can be used in polishing of the peripheral portion of the substrate.

Figure 18:
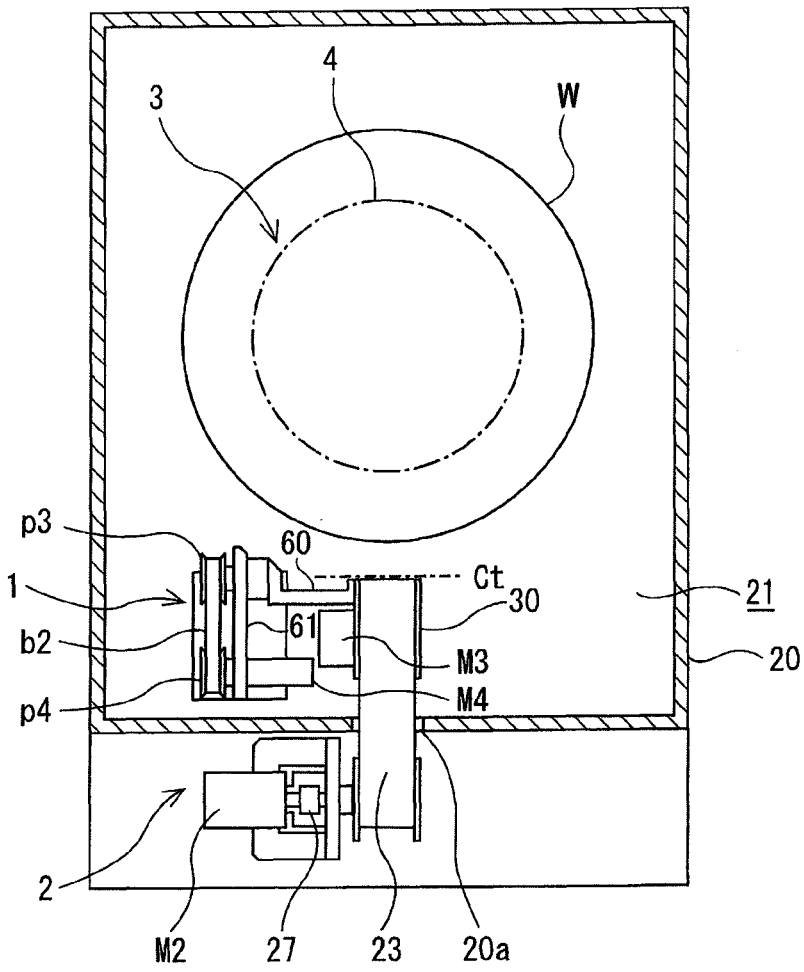
FIG. 18 is a plan view showing an example of the polishing apparatus having a single polishing head assembly and a single polishing-tape supply mechanism.

While the polishing apparatus shown in FIG. 3 includes the four polishing head assemblies and the four polishing-tape supply mechanisms, the present invention is not limited to this embodiment. For example, two, or three, or more than five sets of polishing head assemblies and polishing-tape supply mechanisms may be provided. Further, as shown in FIG. 18, the polishing apparatus may have a single polishing head assembly 1 and a single polishing-tape supply mechanism 2.

Figure 19:
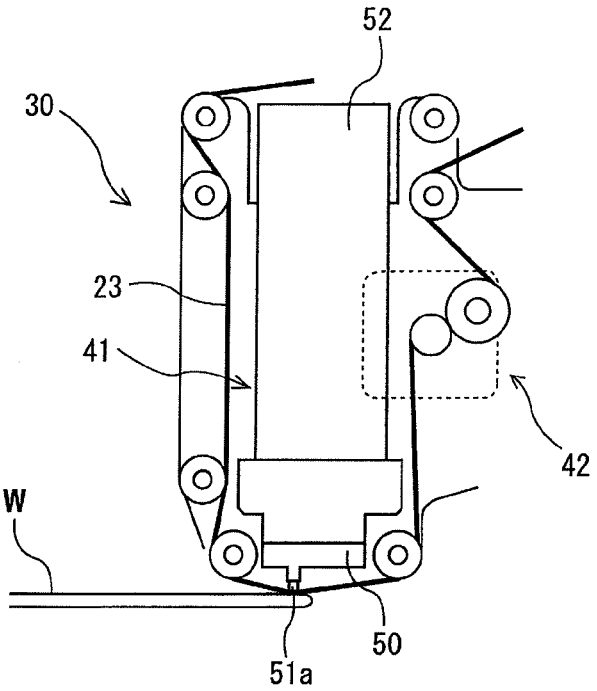
FIG. 19 is a side view showing the polishing head having a single protrusion arranged so as to face the top edge portion of the substrate.
Figure 20:
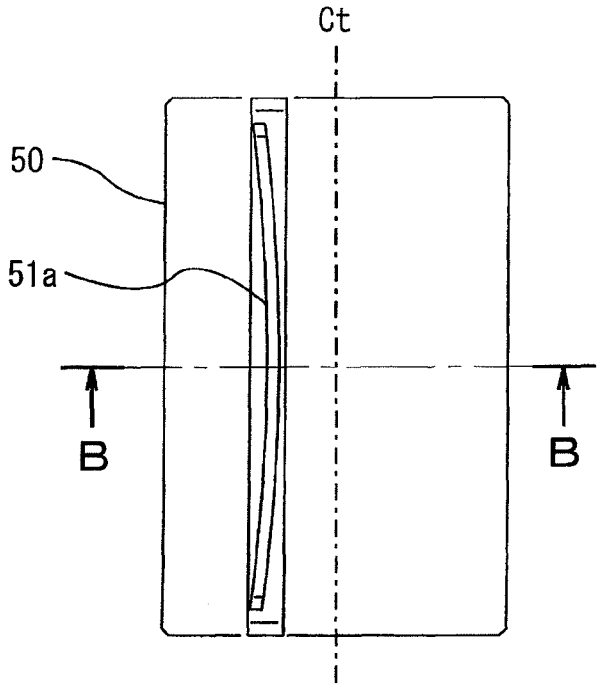
FIG. 20 is a front view of a pressing member shown in FIG. 19.
Figure 21:
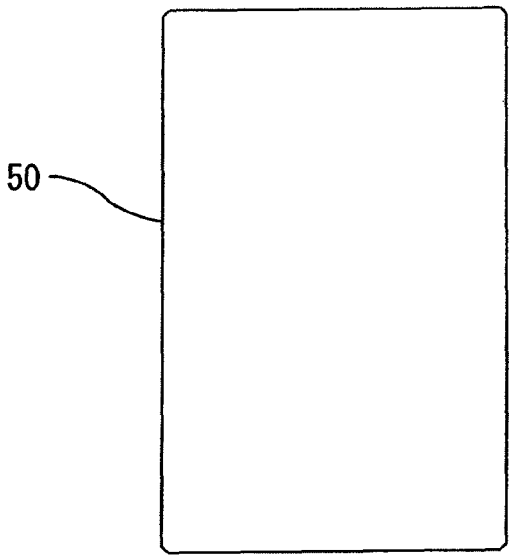
FIG. 21 is a rear view of the pressing member shown in FIG. 20.
Figure 22:
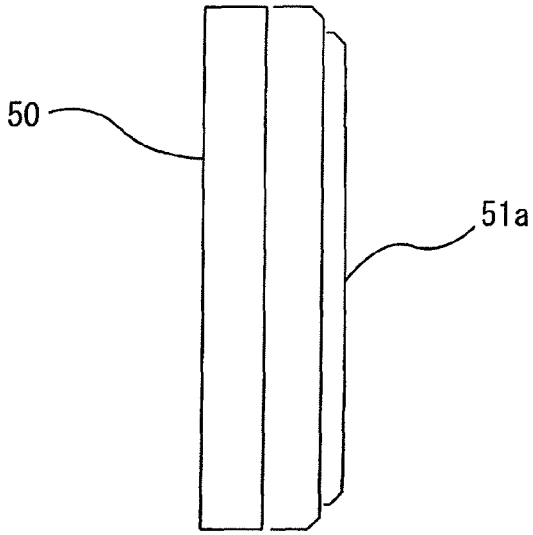
FIG. 22 is a left-side view of the pressing member shown in FIG. 20.
Figure 23:
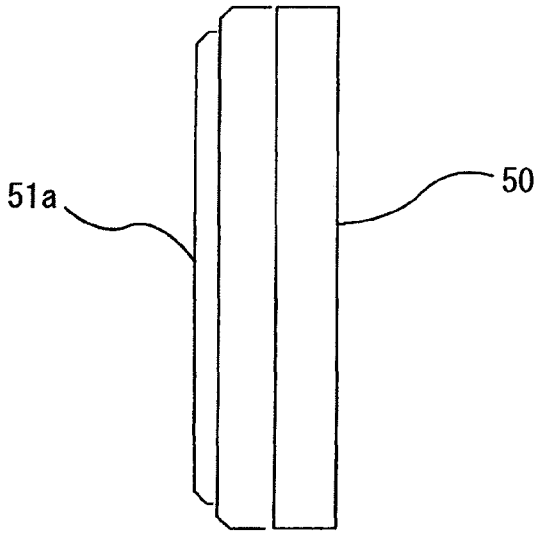
FIG. 23 is a right-side view of the pressing member shown in FIG. 20.
Figure 24:
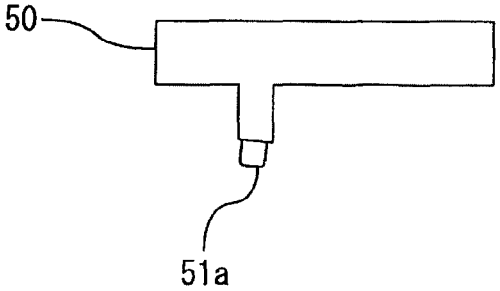
FIG. 24 is a top view of the pressing member shown in FIG. 20.
Figure 25:
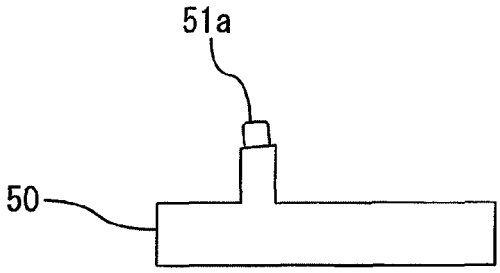
FIG. 25 is a bottom view of the pressing member shown in FIG. 20.
Figure 26:
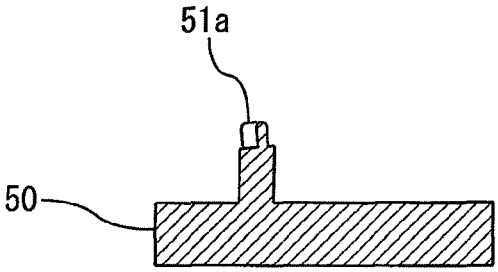
FIG. 26 is a cross-sectional view taken along line B-B in FIG. 20.
Figure 27:
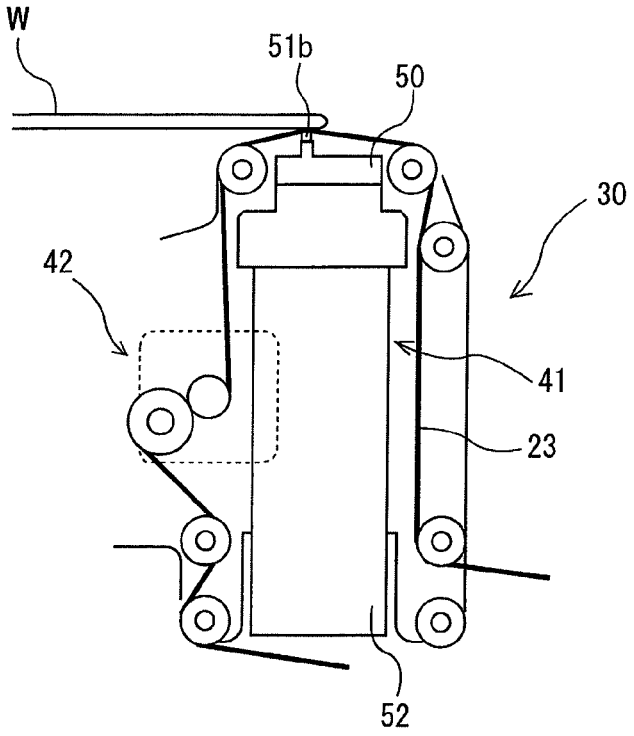
FIG. 27 is a side view showing the polishing head having a single protrusion arranged so as to face a bottom edge portion of the substrate.

While the two protrusions are provided in the above-described polishing apparatus, only a single protrusion may be provided. FIG. 19 is a side view showing the polishing head having a single protrusion arranged so as to face the top edge portion of the substrate. FIG. 20 through FIG. 25 are front, rear, left-side, right-side, top, and bottom views of a pressing member shown in FIG. 19. FIG. 26 is a view taken along line B-B shown in FIG. 20. FIG. 27 is a side view showing the polishing head having a single protrusion arranged so as to face the bottom edge portion of the substrate. In these examples also, the protrusions 51*a* and 51*b* are curved along the peripheral portion of the substrate (i.e., along the top edge portion and the bottom edge portion). Front, rear, left-side, right-side, top, and bottom views of a pressing member shown in FIG. 27 are substantially identical to the views shown in FIG. 20 through FIG. 25 and are therefore omitted.

Figure 2C:
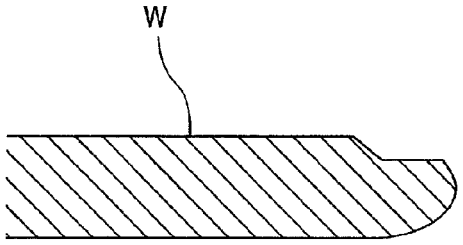
FIG. 2C PRIOR ART
FIG. 2C is a schematic view showing a cross section of the peripheral portion of the substrate that has been polished by the polishing apparatus shown in FIG. 2A.

The protrusion 51*a* shown in FIG. 19 is arranged above the peripheral portion of the substrate W and is curved along the top edge portion. Therefore, the protrusion 51*a* is used only for polishing of the top edge portion and is not used for polishing of the bottom edge portion. On the other hand, the protrusion 51*b* shown in FIG. 27 is arranged below the peripheral portion of the substrate W and is curved along the bottom edge portion. Therefore, the protrusion 51*b* is used only for the bottom edge portion and is not used for the top edge portion. In these examples, the above-described tilting mechanism may be omitted. In this case, it is preferable that the polishing head assemblies 1A to 1D shown in FIG. 2 include the polishing head assembly for polishing the top edge portion and the polishing head assembly for polishing the bottom edge portion. Further, in these examples, the inclination angle $\alpha$ (see FIG. 13) of the pressing surfaces of the protrusions 51*a* and 51*b* may be zero. In other words, the polishing head 30 may be provided in a position perpendicular to the surface of the substrate W, and the pressing surfaces of the protrusions 51*a* and 51*b* may be parallel to the surface of the substrate W.

As shown in FIG. 19 and FIG. 27, the polishing tape 23 is supported by the protrusion 51*a* or the protrusion 51*b*. As a result, a space is formed between the polishing tape 23 and the pressing member 50. Therefore, in these examples also, most of the polishing liquid, that has been spun off from the rotating substrate W, passes through the space between the polishing tape 23 and the pressing member 50 without impinging upon the pressing member 50. In particular, in the examples shown in FIG. 19 and FIG. 27, the protrusion (51*b* or 51*a*) does not exist in a position radially outwardly of the substrate W when polishing the top edge portion and the bottom edge portion. Therefore, the polishing liquid that has been scattered from the substrate W does not impinge upon the pressing member 50. As a result, contamination of the substrate W due to particles, such as polishing debris, contained in the polishing liquid can be prevented.

Figure 34:
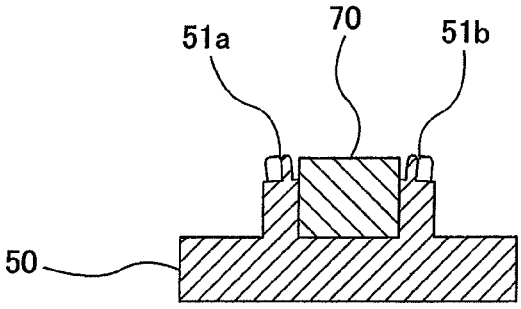
FIG. 34 is a cross-sectional view taken along line C-C in FIG. 28.

FIG. 28 through FIG. 33 are front, rear, left-side, right-side, top, and bottom views of still another example of the pressing member 50. FIG. 34 is a view taken along line C-C shown in FIG. 28. The pressing member 50 shown in FIG. 28 through FIG. 34 is different from the pressing member 50 shown in FIG. 6 through FIG. 13 in that a pressing pad (bevel pad) 70 is provided between the two protrusions 51*a* and 51*b*. Other structures of the pressing member 50 that are not described below are identical to those of the pressing member 50 shown in FIG. 6 through FIG. 13 and repetitive descriptions will be omitted.

The pressing pad 70 is located at the center of the pressing member 50. Arrangement of the pressing pad 70 is such that the pressing pad 70 faces the bevel portion (see FIG. 1A and FIG. 1B) of the substrate on the rotary holding mechanism 3 when the polishing head 30 is in a horizontal position. The pressing pad 70 is made from closed-cell foam material (e.g., silicone rubber) having elasticity. When the pressing member 50 is moved toward the substrate by the air cylinder 52 with the polishing head 30 in the horizontal position, the pressing pad 70 presses the polishing tape from the rear side thereof against the bevel portion of the substrate. In order to reduce friction with the rear surface of the polishing tape, a sheet having a Teflon-coated surface may be attached to a front surface (i.e., a pressing surface) of the pressing pad 70. This pressing pad 70 is removably attached by bolts or the like.

Figure 35:
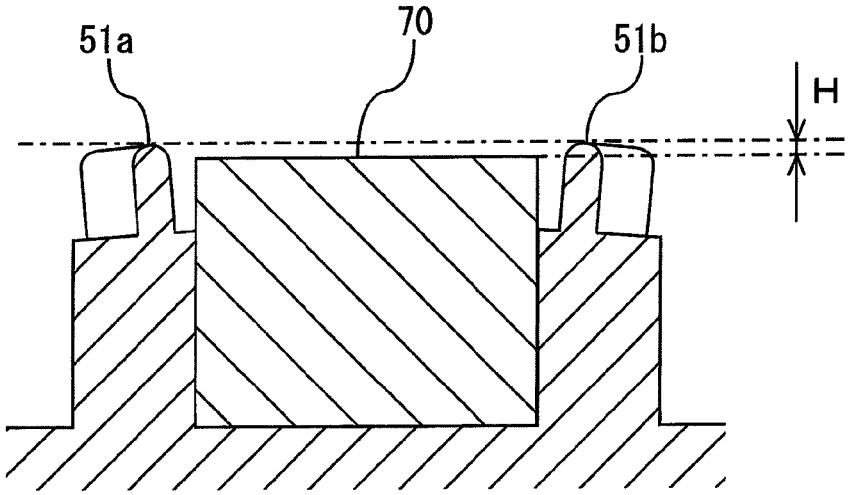
FIG. 35 is an enlarged view of a press pad and protrusions shown in FIG. 34.

FIG. 35 is an enlarged view showing the pressing pad 70 and the protrusions 51*a* and 51*b*. As shown in FIG. 35, a height of the pressing pad 70 is slightly lower than a height of the protrusions 51*a* and 51*b*. This is for preventing the pressing pad 70 from pressing the polishing tape against the substrate when polishing the substrate with the protrusion 51*a* or the protrusion 51*b*. A difference in height between the protrusions 51*a* and 51*b* and the pressing pad 70 (this difference is indicated by H) is preferably larger than 0 mm and not more than 1 mm.

Figure 28:
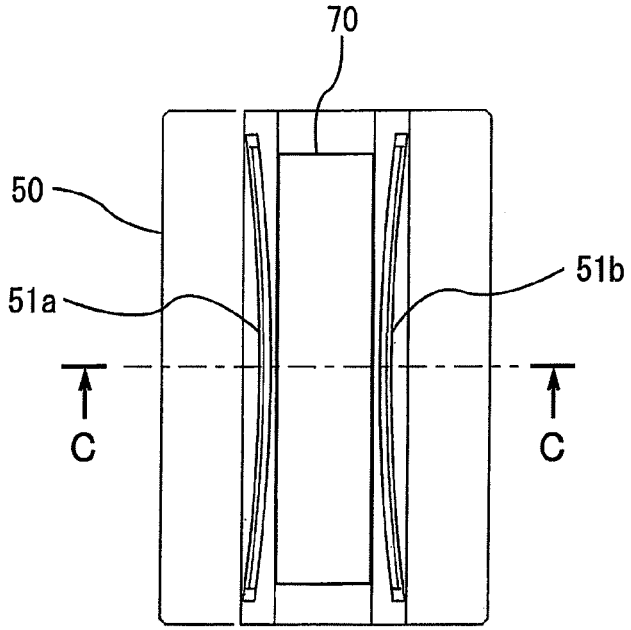
FIG. 28 is a front view showing still another example of the pressing member.
Figure 29:
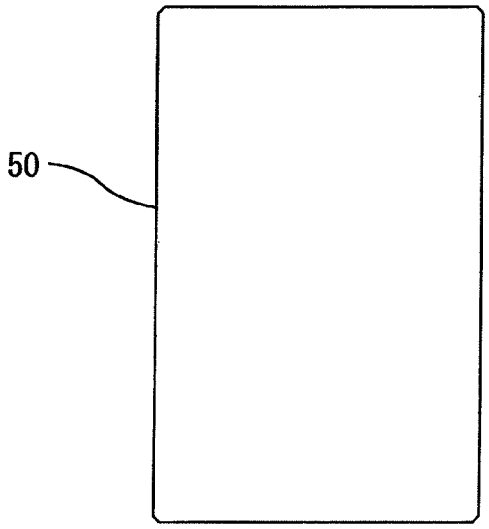
FIG. 29 is a rear view of the pressing member shown in FIG. 28.
Figure 30:
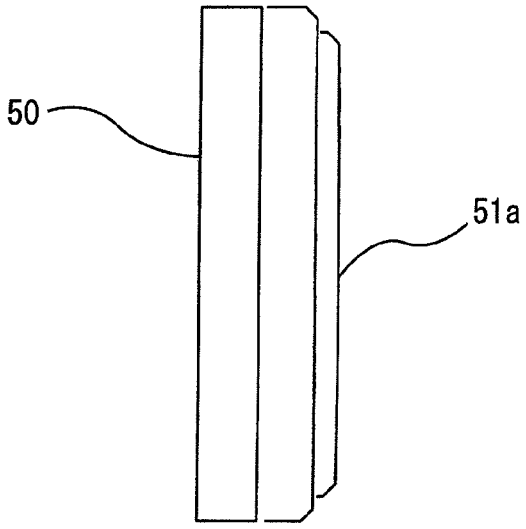
FIG. 30 is a left-side view of the pressing member shown in FIG. 28.
Figure 31:
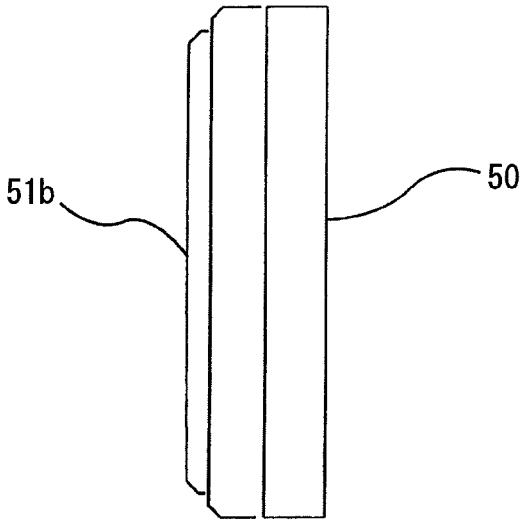
FIG. 31 is a right-side view of the pressing member shown in FIG. 28.
Figure 32:
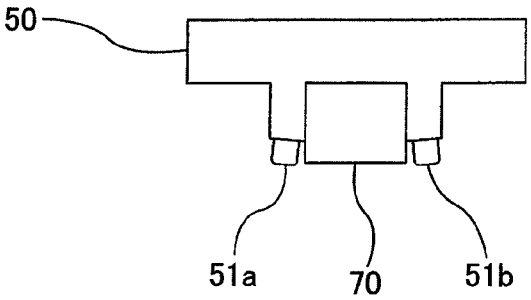
FIG. 32 is a top view of the pressing member shown in FIG. 28.
Figure 33:
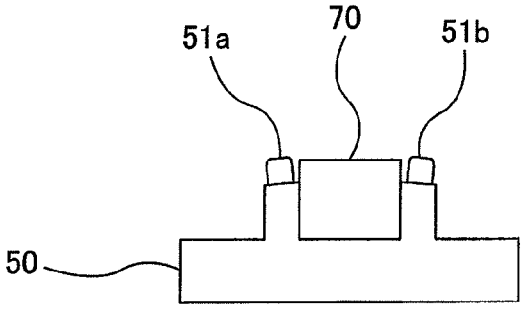
FIG. 33 is a bottom view of the pressing member shown in FIG. 28.
Figure 36:
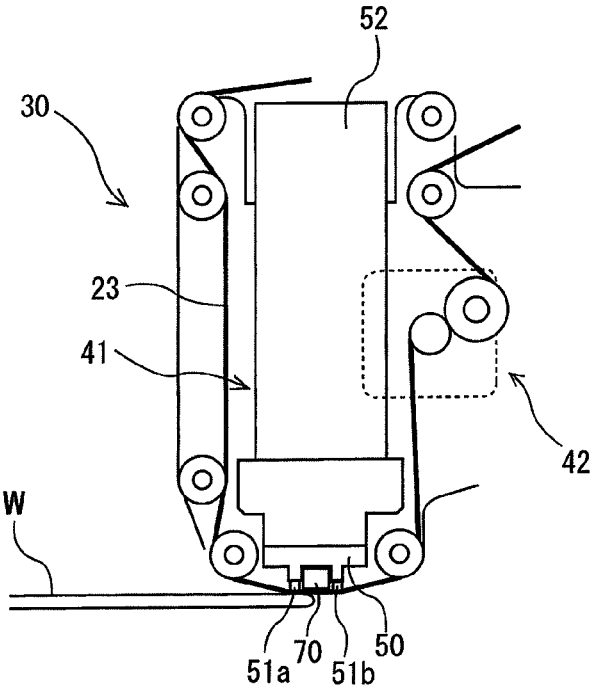
FIG. 36 is a view showing the polishing head inclined upward by the tilting mechanism.
Figure 37:
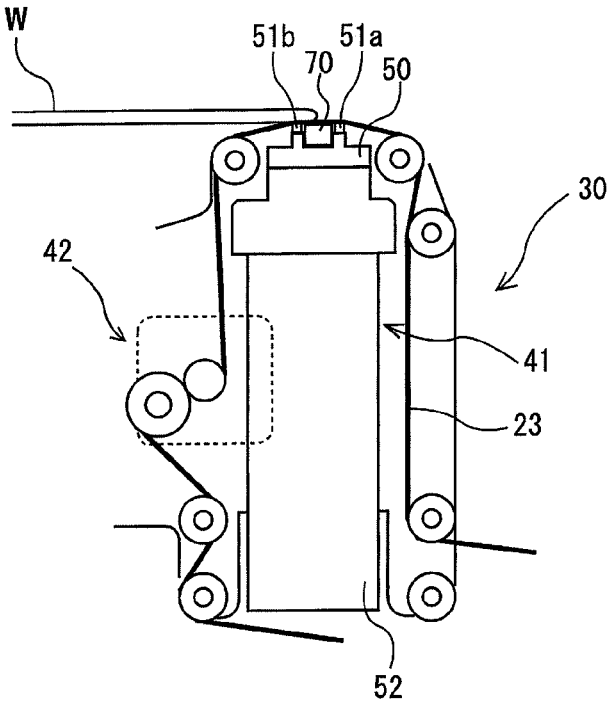
FIG. 37 is a view showing the polishing head inclined downward by the tilting mechanism.
Figure 38:
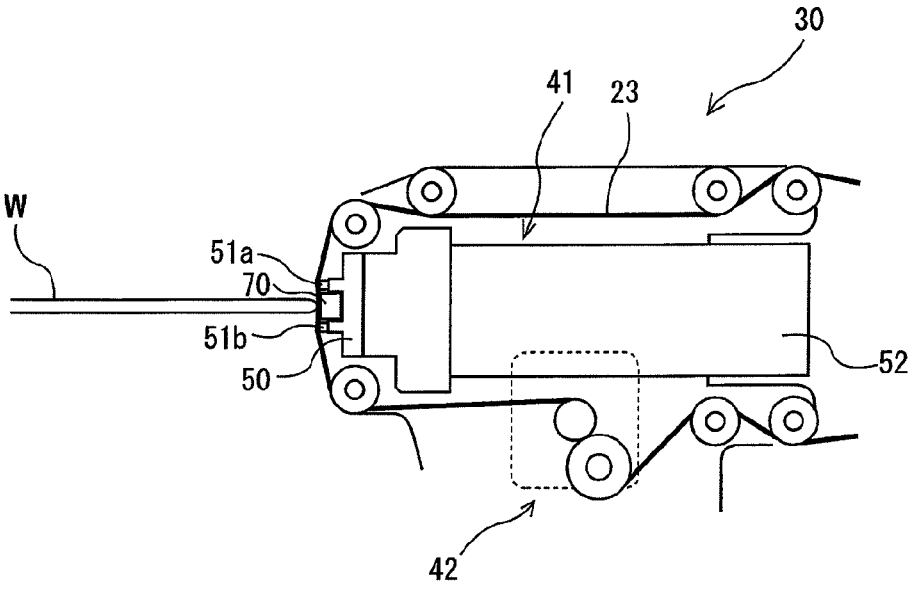
FIG. 38 is a view showing the polishing head in a horizontal position.

FIG. 36 through FIG. 38 are views illustrating an example of a polishing method using the polishing head 30 having the pressing member 50 shown in FIG. 28. As shown in FIG. 36, the polishing head 30 is inclined upward and the polishing tape 23 is pressed by the protrusion 51*a* against the top edge portion of the substrate W to thereby polish the top edge portion. Subsequently, as shown in FIG. 37, the polishing head 30 is inclined downward and the polishing tape 23 is pressed by the protrusion 51*b* against the bottom edge portion of the substrate W to thereby polish the bottom edge portion. Then the polishing head 30 is put to the horizontal position (i.e., the tilt angle with respect to the surface of the substrate W is zero), and the polishing tape 23 is pressed by the pressing pad 70 against the bevel portion of the substrate W to thereby polish the bevel portion.

Figure 39:
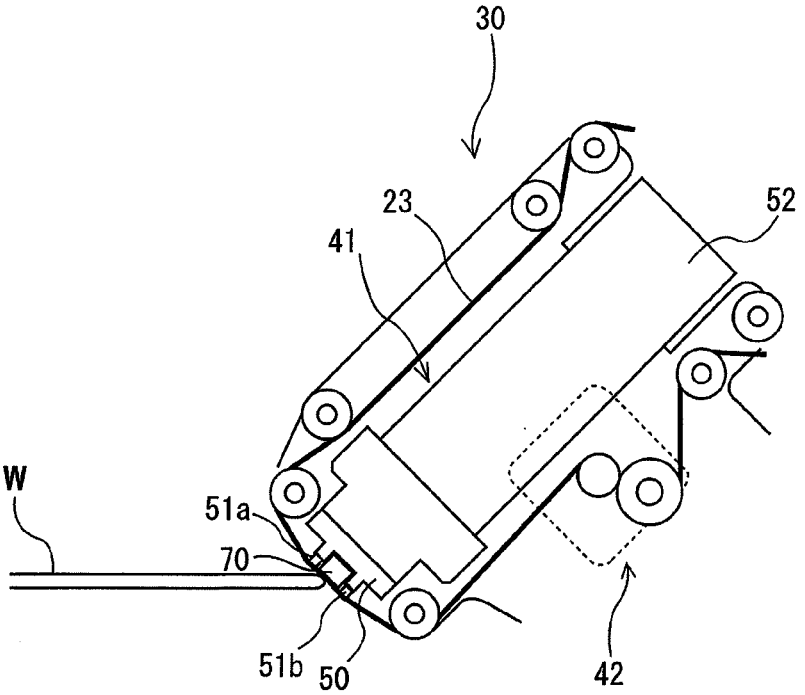
FIG. 39 is a view showing the polishing head inclined upward when polishing the bevel portion of the substrate.
Figure 40:
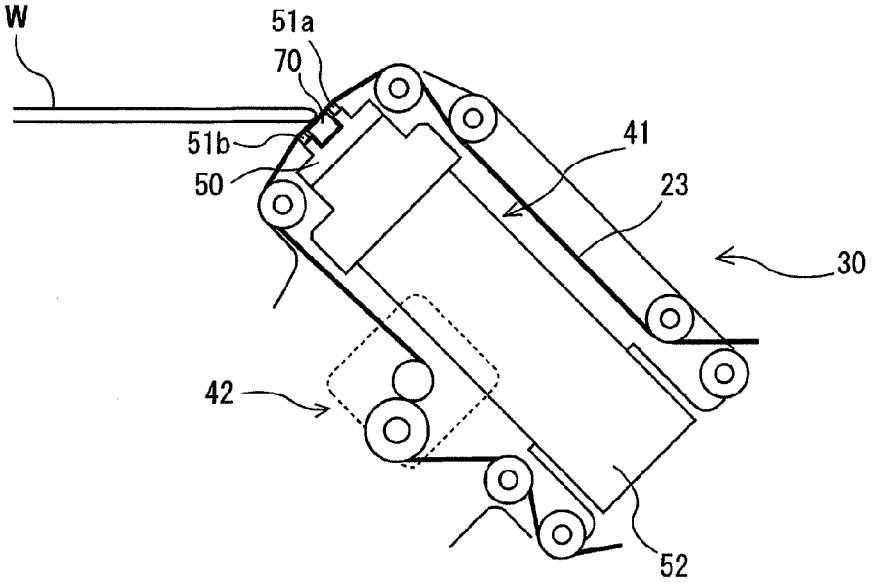
FIG. 40 is a view showing the polishing head inclined downward when polishing the bevel portion of the substrate.
Figure 41:
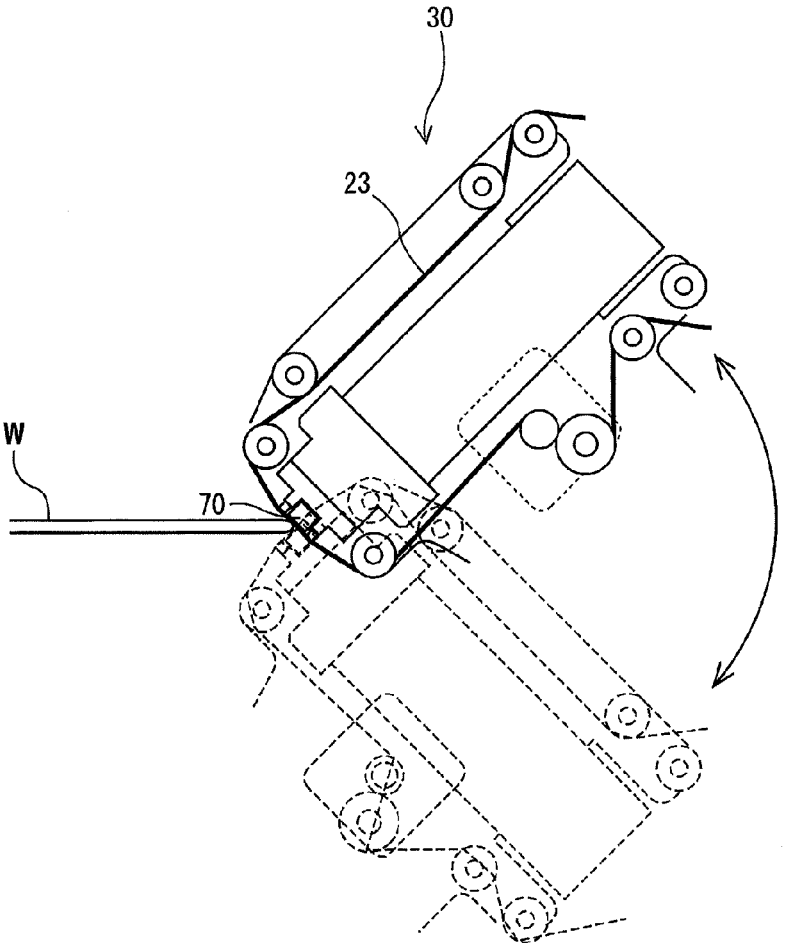
FIG. 41 is a view showing a manner in which a tilt angle of the polishing head is changed continuously when polishing the bevel portion of the substrate.

Further, as shown in FIG. 39 and FIG. 40, the polishing head 30 may be inclined at predetermined angles so that the polishing tape 23 is pressed obliquely against the bevel portion of the substrate W to polish the bevel portion. By tilting the polishing head 30 in this manner, the polishing head 30 can polish the bevel portion in its entirety including the upper slope (upper bevel portion) P, the lower slope (lower bevel portion) Q, and the side portion (apex) R shown in FIG. 1A. Further, as shown in FIG. 41, the tilt angle of the polishing head 30 may be changed continuously by the tilting mechanism while the pressing pad 70 is pressing the polishing tape 23 against the bevel portion of the substrate W.

In this manner, use of the pressing member 50 having the protrusions 51*a* and 51*b* and the pressing pad 70 can enable the polishing tape 23 to polish the peripheral portion of the substrate W in its entirety. Sequence of polishing of the top edge portion, the bevel portion, and the bottom edge portion can be determined from a type, a target shape, and the like of the substrate. Examples of polishing sequence are as follows.

Top edge portion→Bottom edge portion→Bevel portion
Bottom edge portion→Top edge portion→Bevel portion
Top edge portion→Bevel portion→Bottom edge portion
Bottom edge portion→Bevel portion→Top edge portion
Bevel portion→Top edge portion→Bottom edge portion
Bevel portion→Bottom edge portion→Top edge portion In addition to the above-described examples, it is also possible to polish only the top edge portion, only the bevel portion, or only the bottom edge portion. Further, it is also possible to polish the top edge portion or bottom edge portion and the bevel portion in desired sequences. In this manner, use of the pressing member 50 having the protrusions 51*a* and 51*b* and the pressing pad 70 enables the polishing tape 23 to polish not only the top edge portion and the bottom edge portion, but also the bevel portion.

Figure 42:
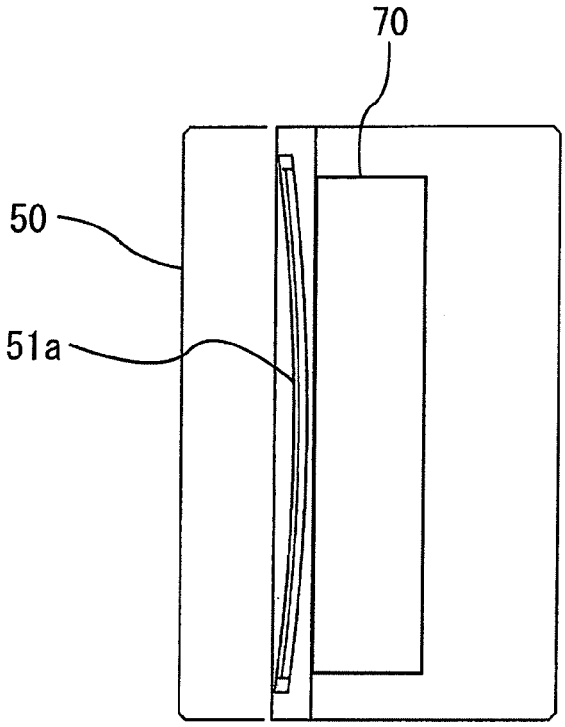
FIG. 42 is a front view of a pressing member having a pressing pad adjacent to the protrusion for pressing the top edge portion of the substrate.
Figure 43:
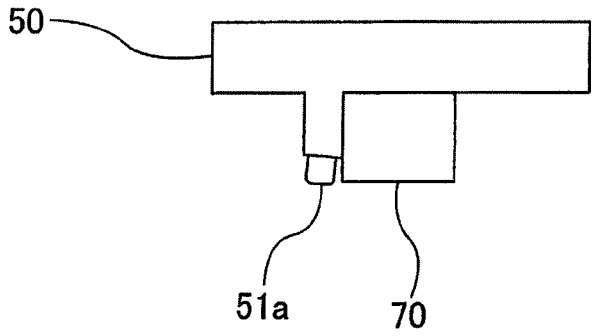
FIG. 43 is a top view of the pressing member shown in FIG. 42.
Figure 44:
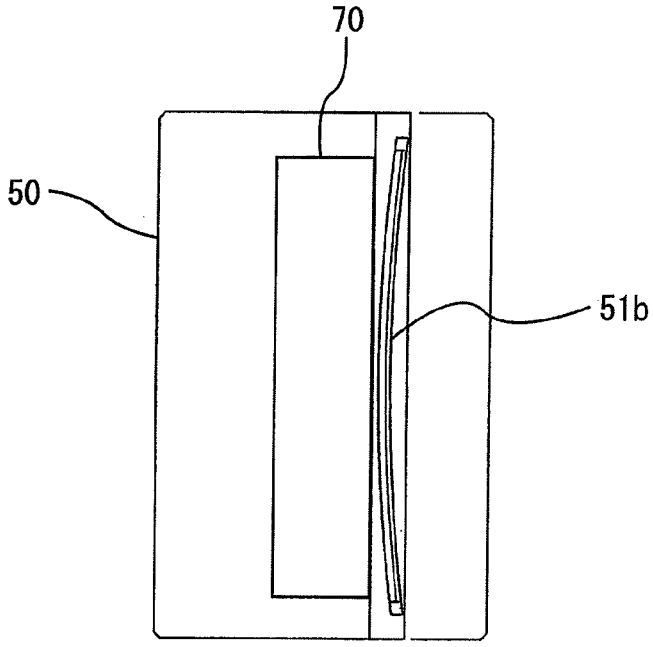
FIG. 44 is a front view of a pressing member having a pressing pad adjacent to the protrusion for pressing the bottom edge portion of the substrate.
Figure 45:
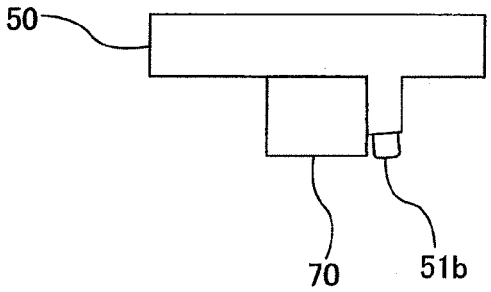
FIG. 45 is a top view of the pressing member shown in FIG. 44.

While the pressing pad 70 is disposed between the two protrusions 51*a* and 51*b* in the example shown in FIG. 28, the pressing pad 70 may be applied to the pressing member 50 shown in FIG. 19 through FIG. 27. FIG. 42 is a front view of the pressing member 50 having the pressing pad 70 that is adjacent to the protrusion 51*a* for pressing the top edge portion of the substrate. FIG. 43 is a top view of the pressing member 50 shown in FIG. 42. FIG. 44 is a front view of the pressing member 50 having the pressing pad 70 that is adjacent to the protrusion 51*b* for pressing the bottom edge portion of the substrate. FIG. 45 is a top view of the pressing member 50 shown in FIG. 44. As shown in FIG. 42 through FIG. 45, the pressing pad 70 may be adjacent to the protrusion 51*a* or the protrusion 51*b*. The location and the shape of the pressing pad 70 in these examples are identical to those of the pressing pad 70 shown in FIG. 28 through FIG. 33.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A polishing apparatus for polishing a peripheral portion of a substrate, the peripheral portion including a near-edge portion having an annular flat surface, said polishing apparatus comprising:

a rotary holding mechanism configured to hold the substrate horizontally and to rotate the substrate;

at least one polishing head disposed near the near-edge portion of the substrate; and a polishing-tool supply mechanism configured to supply a strip-shaped polishing tool in a radial direction of the substrate to said at least one polishing head and collect the polishing tool from said at least one polishing head, wherein said at least one polishing head has at least one protrusion curved along a circumferential direction of the substrate such that a distance between said at least one protrusion and an outermost circumference of the substrate is constant throughout an entire length of said at least one protrusion, and wherein said at least one polishing head is configured to bring said at least one protrusion into contact with a rear surface of the strip-shaped polishing tool to thereby press the strip-shaped polishing tool downwardly or upwardly against the near-edge portion of the substrate.

2. The polishing apparatus according to claim 1, wherein said at least one protrusion has a circular arc shape that has substantially a same curvature as the substrate.

3. A polishing apparatus for polishing a peripheral portion of a substrate, said polishing apparatus comprising:

a rotary holding mechanism configured to hold the substrate horizontally and to rotate the substrate;

at least one polishing head disposed near the peripheral portion of the substrate;

a polishing-tool supply mechanism configured to supply a strip-shaped polishing tool in a radial direction of the substrate to said at least one polishing head and collect the polishing tool from said at least one polishing head; and at least one tilting mechanism configured to tilt said at least one polishing head with respect to a surface of the substrate, wherein said at least one polishing head has a first protrusion and a second protrusion that are symmetrically arranged and curved along a circumferential direction of the substrate, said at least one polishing head is configured to bring said first and second protrusions into contact with a rear surface of the strip-shaped polishing tool to thereby press the strip-shaped polishing tool downwardly or upwardly against the peripheral portion of the substrate, said first protrusion is located above the peripheral portion of the substrate when said at least one polishing head is tilted upward, and said second protrusion is located below the peripheral portion of the substrate when said at least one polishing head is tilted downward.

4. The polishing apparatus according to claim 3, wherein:

said first protrusion presses the strip-shaped polishing tool against a top edge portion of the substrate; and said second protrusion presses the strip-shaped polishing tool against a bottom edge portion of the substrate.

5. The polishing apparatus according to claim 3, wherein:

said at least one polishing head comprises plural polishing heads arranged around the substrate; and said at least one tilting mechanism comprises plural tilting mechanisms configured to tilt said plural polishing heads independently.

6. The polishing apparatus according to claim 3, wherein said at least one polishing head further has a pressing pad configured to press the strip-shaped polishing tool against the peripheral portion of the substrate, and said pressing pad is disposed between said first protrusion and said second protrusion.

7. The polishing apparatus according to claim 6, wherein a height of said pressing pad is lower than a height of said first protrusion and said second protrusion.

8. The polishing apparatus according to claim 1, wherein said at least one polishing head further has a pressing pad configured to press the strip-shaped polishing tool against the peripheral portion of the substrate, and said pressing pad is adjacent to said at least one protrusion.

9. The polishing apparatus according to claim 1, wherein a length of said at least one protrusion is longer than a width of the strip-shaped polishing tool.

10. The polishing apparatus according to claim 1, wherein:

said at least one polishing head includes two guide rollers that support a polishing surface of the strip-shaped polishing tool and further includes an actuator coupled to said two guide rollers and said at least one protrusion;

said at least one protrusion is interposed between said two guide rollers; and said actuator is configured to move said two guide rollers and said at least one protrusion in unison toward the peripheral portion of the substrate.

11. The polishing apparatus according to claim 1, wherein the strip-shaped polishing tool is a polishing tape or a polishing cloth.

12. A polishing apparatus for polishing a peripheral portion of a substrate, said polishing apparatus comprising:

a rotary holding mechanism configured to hold the substrate horizontally and to rotate the substrate;

a polishing head disposed near the peripheral portion of the substrate; and a tilting mechanism configured to tilt said polishing head with respect to a surface of the substrate, wherein said polishing head has a first protrusion and a second protrusion extending along a circumferential direction of the substrate and further has a pressing pad disposed between said first protrusion and said second protrusion, and wherein said polishing head is configured to bring said first protrusion into contact with a rear surface of a strip-shaped polishing tool to thereby press the strip-shaped polishing tool downwardly against the peripheral portion of the substrate, to bring said second protrusion into contact with the rear surface of the strip-shaped polishing tool to thereby press the strip-shaped polishing tool upwardly against the peripheral portion of the substrate, and to bring said pressing pad into contact with the rear surface of the strip-shaped polishing tool to thereby press the strip-shaped polishing tool against the peripheral portion of the substrate.

13. A polishing method using said polishing apparatus according to claim 3, said polishing method comprising:

rotating a substrate by said rotary holding mechanism;

bringing said first protrusion into contact with the rear surface of the strip-shaped polishing tool to press the strip-shaped polishing tool downwardly against a peripheral portion of the substrate thereby polishing a top edge portion of the substrate; and bringing said second protrusion into contact with the rear surface of the strip-shaped polishing tool to press the strip-shaped polishing tool upwardly against the peripheral portion of the substrate thereby polishing a bottom edge portion of the substrate.

14. The polishing method according to claim 13, further comprising:

before said polishing of the top edge portion, tilting said at least one polishing head upward by said at least one tilting mechanism; and before said polishing of the bottom edge portion, tilting said at least one polishing head downward by said at least one tilting mechanism.

15. The polishing method according to claim 13, wherein the strip-shaped polishing tool is a polishing tape or a polishing cloth.

16. A polishing method using said polishing apparatus according to claim 6, said polishing method comprising:

rotating a substrate by said rotary holding mechanism;

bringing said first protrusion into contact with the rear surface of the strip-shaped polishing tool to press the strip-shaped polishing tool downwardly against a peripheral portion of the substrate thereby polishing a top edge portion of the substrate;

bringing said second protrusion into contact with the rear surface of the strip-shaped polishing tool to press the strip-shaped polishing tool upwardly against the peripheral portion of the substrate thereby polishing a bottom edge portion of the substrate; and bringing said pressing pad into contact with the rear surface of the strip-shaped polishing tool to press the strip-shaped polishing tool against the peripheral portion of the substrate thereby polishing a bevel portion of the substrate.

17. The polishing method according to claim 16, wherein said polishing of the bevel portion of the substrate includes pressing the strip-shaped polishing tool against the peripheral portion of the substrate with said at least one polishing head tilted.

18. The polishing method according to claim 16, wherein the strip-shaped polishing tool is a polishing tape or a polishing cloth.

19. A polishing method using said polishing apparatus according to claim 5, said polishing method comprising:

rotating a substrate by said rotary holding mechanism;

pressing a strip-shaped polishing tool by a first polishing head against a peripheral portion of the substrate thereby polishing a top edge portion of the substrate;

pressing the strip-shaped polishing tool by said first polishing head against the peripheral portion of the substrate thereby polishing a bottom edge portion of the substrate; and during said polishing of the bottom edge portion by said first polishing head, pressing a strip-shaped polishing tool by a second polishing head against the peripheral portion of the substrate thereby polishing the top edge portion.

20. The polishing method according to claim 19, wherein the strip-shaped polishing tool is a polishing tape or a polishing cloth.

21. A polishing method using said polishing apparatus according to claim 5, said polishing method comprising:

rotating a substrate by said rotary holding mechanism;

pressing a strip-shaped polishing tool by a first polishing head against a peripheral portion of the substrate thereby polishing a top edge portion of the substrate; and pressing a strip-shaped polishing tool by a second polishing head against the peripheral portion of the substrate thereby polishing a bottom edge portion of the substrate.

22. The polishing method according to claim 21, wherein the strip-shaped polishing tool is a polishing tape or a polishing cloth.

23. A pressing member for pressing a strip-shaped polishing tool against a near-edge portion, having a flat surface, of a peripheral portion of a substrate, said pressing member comprising:

at least one protrusion to be brought into contact with a rear surface of the strip-shaped polishing tool, said at least one protrusion being curved along a circumferential direction of the substrate such that a distance between said at least one protrusion and an outermost circumference of the substrate is constant throughout an entire length of said at least one protrusion.

24. A pressing member for pressing a strip-shaped polishing tool against a peripheral portion of a substrate, the peripheral portion including a near-edge portion having a flat surface, said pressing member comprising:

a first protrusion to be brought into contact with a rear surface of the strip-shaped polishing tool;

a second protrusion to be brought into contact with the rear surface of the strip-shaped polishing tool; and a pressing pad that presses the strip-shaped polishing tool against the peripheral portion of the substrate, wherein said first protrusion is curved along a circumferential direction of the substrate such that a distance between said first protrusion and an outermost circumference of the substrate is constant throughout an entire length of said first protrusion, said second protrusion is curved along the circumferential direction of the substrate such that a distance between said second protrusion and an outermost circumference of the substrate is constant throughout an entire length of said second protrusion, said first and second protrusions are arranged symmetrically, and said pressing pad is disposed between said first protrusion and said second protrusion.

25. The pressing member according to claim 24, wherein a height of said pressing pad is lower than a height of said first protrusion and said second protrusion.

26. The pressing member according to claim 23, wherein the strip-shaped polishing tool is a polishing tape or a polishing cloth.

27. The polishing apparatus according to claim 1, wherein said at least one protrusion has a pressing surface with a rounded cross section.

28. The pressing member according to claim 23, wherein said at least one protrusion has a pressing surface with a rounded cross section.

29. The polishing apparatus according to claim 1, wherein said at least one protrusion extends parallel to the flat surface of the near-edge portion while being curved along the circumferential direction of the substrate.

30. The pressing member according to claim 23, wherein said at least one protrusion extends parallel to the flat surface of the near-edge portion while being curved along the circumferential direction of the substrate.

31. The pressing member according to claim 24, wherein said first and second protrusions extend parallel to the flat surface of the near-edge portion while being curved along the circumferential direction of the substrate.

* * * * *